US005117594A

United States Patent [19]

Muramoto et al.

[11] Patent Number: 5,117,594

[45] Date of Patent: Jun. 2, 1992

[54] OPENABLE ROOF APPARATUS

[75] Inventors: Hiroki Muramoto, Hiroshima; Shuji Okuda, Tokyo; Kenichi Sugizaki, Tokyo; Toshihiko Hirama, Tokyo; Hajime Nakajima, Tokyo, all of Japan

[73] Assignee: Mitsubishi Jukogyo Kabushiki Kaisha Shimizu Construction Co., Japan

[21] Appl. No.: 502,613

[22] Filed: Mar. 30, 1990

[30] Foreign Application Priority Data

| | | | |
|---|---|---|---|
| Mar. 30, 1989 | [JP] | Japan | 1-79261 |
| Mar. 30, 1989 | [JP] | Japan | 1-79262 |
| Mar. 30, 1989 | [JP] | Japan | 1-79264 |
| May 22, 1989 | [JP] | Japan | 1-128269 |

[51] Int. Cl.[5] ..... E04B 7/16

[52] U.S. Cl. ..... 52/66; 52/6

[58] Field of Search ..... 52/6, 7, 8, 9, 65, 66

[56] References Cited

U.S. PATENT DOCUMENTS

| | | | |
|---|---|---|---|
| 4,587,775 | 5/1986 | Lewis et al. . | |
| 4,676,033 | 6/1987 | Allen et al. . | |
| 4,716,691 | 1/1988 | Allen | 52/6 |
| 4,738,057 | 4/1988 | Logan | 52/6 |
| 4,783,861 | 11/1988 | Leurent . | |

FOREIGN PATENT DOCUMENTS

| | | |
|---|---|---|
| 57-108355 | 7/1982 | Japan . |
| 61-162648 | 7/1986 | Japan . |
| 63-181829 | 7/1988 | Japan . |
| 61183910 | 8/1990 | Japan . |
| 354206 | 8/1931 | United Kingdom . |
| 2179975 | 3/1987 | United Kingdom . |
| 2188957 | 10/1987 | United Kingdom . |
| 2199859 | 7/1988 | United Kingdom . |
| 2230031 | 10/1990 | United Kingdom . |
| 8606123 | 4/1985 | World Int. Prop. O. . |

OTHER PUBLICATIONS

"Proposal for Retractable Roof Stadium", Phillips Barratt Kaiser Engineering, Aug./Sep. 1984, Toronto Star, Jan. 23, 1985.

*Primary Examiner*—John E. Murtagh

*Attorney, Agent, or Firm*—Scully, Scott, Murphy & Presser

[57] ABSTRACT

In an openable roof apparatus for a space, a stationary support structure is arranged about the space. A movable roof structure is supported by the stationary support structure and is movable with respect thereto. The movable roof structure having a first movable roof section and a second swing roof section. The second swing roof section is movable angularly about the central axis of the space with respect to the first movable roof section and is capable of being overlapped therewith. A guide arrangement is arranged on the stationary support structure and extends perpendicularly to a central axis of the space. The first movable roof section and the second swing roof section, which are overlapped with each other, are movable along the guide arrangement toward and away from the space.

26 Claims, 19 Drawing Sheets

208
T11
T11
211a
211
221
212a
212
B
212
212a
R12
S
R12
R11
R11
A
208
T11
T11
211a
221
211

OPENABLE ROOF APPARATUS

BACKGROUND OF THE INVENTION

The present invention relates to an openable roof apparatus comprising a movable roof structure which is constructed above a large space or equipment or establishment such as a stadium, a concert hall, an event site or the like and which can freely be moved between an open position where the space is open and a closed position where the space is closed.

An openable roof apparatus can fulfill such various demands that it is possible to obtain an open feeling of the outdoors, fresh air, and so on, and it is possible also to remove or eliminate an evil due to rainy weather. These demands are contrary to each other. Many openable roof apparatuses have already been provided or proposed.

For instance, an openable roof apparatus is known which is of collapsible type comprising a roof structure. The roof structure is composed of a plurality of plane plates which are folded up and extended or expanded to move the roof structure between an object position where a space or roof building subject such as a stadium, a concert hall, an event site or the like is open and a closed positon where the space is closed.

Alternatively, as shown in FIG. 35 of the drawings attached hereto, an openable roof apparatus comprises a roof structure which is composed of a stationary roof section 1 and a movable roof section 2. The movable roof section 2 is moved to a position above or within the stationary roof section 1 to open a part of the space S.

Further, as shown in FIGS. 36 and 37, an openable roof apparatus is also known which comprises a movable roof section. The movable roof section is composed of at least two roof units 3 and 3 each of which is formed into a sectorial shape. The roof units 3 are moved angularly about a post 4 which is located at a center of the sectorial shape, whereby the movable roof section can open and close the space S. The roof units 3 jointly use the common center of angular movement. Moreover, a first support leg 5 and a second support leg 6 supporting each roof unit 3 are arranged respectively adjacent an arc of the sectorial shape forming the roof unit 3 and adjacent the center of the angular movement. The first and second legs 5 and 6 are provided respectively with slide mechanisms which are movable respectively along arcuate tracks 7 and 8.

By the way, in such conventional openable roof apparatuses, an early object can be achieved in that the roof structure can be moved between the open and closed positions. However, the conventional openable roof apparatuses have the following problems.

That is, in the openable roof apparatus of collapsible type, an accommodating section is newly required for the collapsible roof structure. Further, not only an operating mechanism becomes troublesome or cumbersome, but also a form of the roof structure is limited to a flat or plain configuration in the form of plates from the viewpoint of its construction. The openable roof apparatus lacks in its decorative design when the building is viewed as a whole.

Further, in the openable roof apparatus shown in FIG. 35, since an escaping space is required for the movable roof section 2 to be withdrawn or removed, a precise or valuable space is sacrificed. Further, since the roof arrangement becomes its form in which the movable roof section 2 is supported by the stationary roof section 1, it is required that the stationary roof section 1 is strengthened in its construction. Moreover, since the movable roof section 2 becomes also its form in which the movable roof section 2 is supported in a cantilever manner, its construction is required to be strengthened. Thus, the cost increases.

On the other hand, the openable roof apparatus shown in FIGS. 36 and 37 has such an advantage that it is possible to easily and optionally move the roof units 3 between the open and closed positions with respect to the space S. However, the following various problems to be improved arise. That is, the stability of the roof structure in the closed position, driving of the roof units 3, and so on are deteriorated so that the openable roof apparatus is not necessarily practical in use. Further, presence of the post 4 at the center of angular movement of the roof units 3 serves as a large restriction or limitation when the space S is designed above which the movable roof structure is built. Moreover, in the type in which each of the roof units 3 is supported at its center of angular movement, there are such problems that stress is concentrated with respect to the post 4 at the center of angular movement, stress is concentrated with respect to a centrl section of the roof unit 3 per se, and so on. Accordingly, it becomes difficult to design the movable roof structure at low cost from the viewpoints of its construction, at reduction in weight, and so on. Furthermore, in order to move the movable roof structure between its open and closed positions by 100%, it is required that a sidewall section of the movable roof unit 3 is also moved, simultaneously with the roof unit 3, between a closed position where the sidewall section surrounds the space S and an open position where the sidewall section is moved away from the space S. Accordingly, the cost increases.

SUMMARY OF THE INVENTION

It is therefore an object of the invention to provide an openable roof apparatus in which a space can be open and closed by such a simple system that a swing roof section is moved angularly about an axis of a space with respect to a movable roof section, and the swing and movable roof sections are then moved straight.

It is another object of the invention to provide an openable roof apparatus in which a swing roof section comprises at last two swing roof units, and each of the swing room units has its both ends which are mounted respectively on a pair of arcuate rail means, whereby the openable roof apparatus can be designed at low cost, can be reduced in weight, can be reduced in cost and so on, and in which the openable roof apparatus is new at all in design.

It is still another object of the invention to provide an openable roof apparatus in which a swing roof section comprises a main swing roof unit and pair of subsidiary swing roof units, and each of the main and subsidiary roof units has its both ends which are mounted respectively on a pair of arcuate rail means, whereby the openable roof apparatus can be designed at low cost, can be reduced in weight, can be reduced in cost and so on, and in which the openable roof apparatus is new at all in design.

It is another object of the invention to provide an openable roof apparatus in which a pair of straight rail means, which are arranged respectively on a pair of parallel support sections, are inclined with respect to a horizontal plane.

It is still another object of the invention to provide an openable roof apparatus in which each of a first movable roof section and a second movable roof section is generally semi-circular in plan.

For the purpose, according to the invention, there is provided an openable roof apparatus for a space having its central axis, comprising:

a stationary support structure arranging about the space:

a movable roof structure supported by the stationary support structure and movable with respect thereto, the movable roof structure having a first movable roof section and a second swing roof section, the second swing roof section being movable angularly about the central axis of the space with respect to the first movable roof section and being capable of being overlapped therewith; and guide means arranged on the stationary support structure and extending perpendicularly to a plane including the central axis of the space, the first movable roof section and the second swing roof section, which are overlapped with each other, being movable along the guide means toward and away from the space, wherein the movable roof structure is movable among a closed position where the first movable roof section and the second swing roof section cooperate with each other to close the space, an intermediate position where the second swing roof section is moved angularly about the central axis of the space and is overlapped with the first movable roof section to partially open the space, and an open position where the first movable roof section and the second swing roof section, which are overlapped with each other in the intermediate positon, are moved along the guide means away from the space to open the same.

With the invention constructed as above, the openable roof apparatus is high in stability of the movable roof structure in the closed position as compared with the conventional openable roof apparatus in which a movable roof structure is divided into a plurality of roof units. Further, since the openable roof apparatus is less in driving locations, drive mechanisms at the respective driving locations are simple in structure or construction. Moreover, the second swing roof section is moved angularly about the central axis of the space with respect to the first movable roof section and is overlapped with the latter, and the first movable and second swing roof sections are moved from the intermediate position to the open position. Accordingly, a leaving space for the movable roof structure can be reduced. Thus, the openable roof apparatus is rational very much.

Preferably, the stationary roof structure has a pair of parallel support sections arranged respectively on both sides of the space and extending in parallel relation to each other, and a pair of arcuate support sections arranged respectively on both sides of the space and extending between the pair of parallel support sections in facing relation to each other. The guide means has a pair of straight rail means arranged respectively on the pair of parallel support sections. The first movable roof section has its both ends which are mounted respectively on the pair of straight rail means for movement therealong. The openable roof apparatus further includes a pair of arcuate rail means arranged respectively on the pair of arcuate support sections. The second swing roof section has at least two swing roof units. Each of the swing roof units has its both ends which are mounted respectively on the pair of arcuate rail means for movement therealong. In the intermediate position, the swing roof units are overlapped with each other and with the first movable roof section in a laminated manner.

With the above arrangement of the invention, the movable roof structure comprises the first movable roof section and the second swing roof section. The second swing roof section is composed of the at least two swing roof units. The movable roof structure is movable among the closed, intermediate and open positions with respect to the stationary support structure. In the intermediate position, the swing roof units are overlapped with the movable roof section. In order to move the movable roof structure to the closed position, the swing roof units are moved to their respective predetermined positions to cause the first movable roof section and the swing roof units to cooperate to each other to close the space. In order to move the movable roof structure to the open position, the first movable roof section, with which the swing roof units are overlapped, is moved to the open position to open the space.

That is, in the intermediate position, the swing roof units are stored with respect to the first movable roof section which is one of three movable roof elements and which is moved straight along the pair of straight rail means provided respectively on the parallel support sections. Under this condition, the three movable roof elements, that is, the first movable roof section and the swing roof units are moved in unison straight along the straight rail means to the open position. By this simple system, the large space S can be open 100%. By doing so, it is possible to reduce an influence or affect of wind turbulent flow within the open space. Moreover, since all of the first movable roof section and the swing roof units, which cooperate with each other to form the movable roof structure, have the both-end-supported configuration, the openable roof apparatus can be designed at low cost as compared with an arrangement having cantilever beams or supported by a post which is located at a center of angular movement of swing roof units. Thus, the openable roof apparatus is reduced in weight correspondingly, and the cost is reduced. Furthermore, the first movable roof section and the swing roof units, which cooperate with each other to form the movable roof structure, are moved straight, and the swing roof units are moved angularly about the cental axis of the space. Accordingly, the openable roof apparatus is extremely new or novel in design. Thus, such an advantage, which is absent in the conventional openable roof apparatus, is also created that a viewer has a foreboding of an unexpected function.

Preferably, the stationary roof structure has a pair of parallel support sections arranged respectively on both sides of the space and extending in parallel relation to each other, and a pair of arcuate support sections arranged respectively on both sides of the space and extending between the pair of parallel support sections in facing relation to each other. The guide means has a pair of straight rail means arranged respectively on the pair of parallel support sections. The first movable roof section has its both ends which are mounted respectively on the pair of straight rail means for movement therealong. The openable roof apparatus further includes a pair of arcuate rail means arranged respectively on the pair of arcuate support sections. The second swing roof section has a main swing roof unit and a pair of subsidiary swing roof units. Each of the main and subsidiary swing roof units has its both ends which are mounted respectively on the pair of arcuate rail means for movement therealong. In the closed position, the pair of subsidiary swing roof units cooperate with the main swing roof unit and the first movable roof section to close the space. In the intermediate position, the pair of subsidiary swing roof units are located between the main swing roof unit and the first movable roof section in side-by-side relation to each other, and the main swing roof unit is overlapped with the pair of subsidiary swing roof units and with the first movable roof section in a laminated manner.

With the above arrangement of the invention, the movable roof structure comprises the first movable roof section and the second swing roof section. The second swing roof section is composed of the main swing roof unit and the pair of subsidiary swing roof units. In the intermediate and closed positions, the pair of subsidiary swing roof units are located between the main swing roof unit and the first movable roof section in side-by-side relation to each other, and the main swing roof unit is overlapped with the first movable roof section in a laminated manner. Thus, in order to move the movable roof structure to the closed position, the main and subsidiary swing roof units are moved angularly about the central axis of the space to their respective predetermined positions to close the space. In order to move the movable roof structure to the open position, the main and subsidiary swing roof units, which are stored with respect to the first movable roof section in a three-stage fashion, are moved together with the first movable roof section to fully open the space.

That is, the main and subsidiary swing roof units are stored with respect to the first movable roof section which is one of four movable roof elements and which is moved straight along the pair of straight rail means provided respectively on the parallel support sections. Under this condition, the four elements, that is, the first movable roof section and the main and subsidiary swing roof units are moved in unison straight. By this simple system, the space can be open 100%. By doing so, it is possible to reduce an influence or affect of wind turbulent flow within the open space. Moreover, since all of the first movable roof structure and the main and subsidiary swing roof units, which cooperate with each other to form the movable roof structure, have the both-end-supported configuration, the openable roof apparatus can be designed at low cost as compared with an arrangement having cantilever beams or supported by a post which is located at a center of angular movement of movable roof units. Thus, the openable roof apparatus is reduced in weight correspondingly, and the cost is reduced. Furthermore, the first movable roof section and the three main and subsidiary swing roof units, which cooperate with each other to form the movable roof structure, are moved straight, and the three main and subsidiary swing roof units are moved angularly about the central axis of the space. Accordingly, the openable roof apparatus is extremely new or novel in design. Thus, such an advantage, which is absent in the conventional openable roof apparatus, is also created that a viewer has a foreboding of an unexpected function.

Further, particularly according to the above arrangement of the invention, the openable roof apparatus is arranged such that, in the intermediate and closed positions, the two subsidiary swing roof units are stored in side-by-side relation to each other between the first movable roof section and the main swing roof unit. Accordingly, in spite of the fact that the openable roof apparatus comprises the four movable roof elements, the movable roof structure is of three-layer construction as a whole. Thus, there is obtained such an advantage that the movable roof structure can be reduced in its thickness.

Preferably, the stationary roof structure has a pair of parallel support sections arranged respectively on both sides of the space and extending in parallel relation to each other, and a pair of arcuate support sections arranged respectively on both sides of the space and extending between the pair of parallel support sections in facing relation to each other. The guide means has a pair of straight rail means arranged respectively on the pair of parallel support sections. The pair of straight rail means are inclined with respect to a horizontal plane. The openable roof apparatus further includes a pair of arcuate rail means arranged respectively on the pair of arcuate support sections. The second swing roof section has at least two swing roof units. Each of the swing roof units has its both ends which are mounted respectively on the pair of arcurate rail means for movement therealong. In the intermediate position, the swing roof units are overlapped with each other and with the first movable roof section in a laminated manner.

With the above arrangement of the invention, the first movable roof section is movable along the pair of inclined straight rail means, and the swing roof units are movable angularly about the central axis of the space with respect to the first movable roof section so as to be overlapped therewith in a laminated manner. In order to move the movable roof structure to the closed position, the swing roof units are moved to their respective predetermined positions to cause the first movable roof section and the swing roof units to cooperate with each other to close the space. In order to move the movable roof structure to the open position, the first movable roof section, with which the swing roof units are overlapped, is moved to open the space.

That is, the swing roof units are stored with respect to the first movable roof section which is one of three movable roof elements and which is moved straight along the pair of straight rail means provided respectively on the parallel support sections. Under this condition, the three movable roof elements, that is, the first movable roof section and the swing roof units are moved in unison straight. By this simple system, the space can be open 100%. By doing so, it is possible to reduce an influence or affect of wind turbulent flow within the open space. Further, if the second swing roof structure is moved upwardly toward the upper ends of the inclined straight rail means so that the space is fully open, the openable roof apparatus can approach the actual use form or configuration such as a baseball stadium or the like. That is, a vast or extensive area in front of a viewer's view breaks open so that the viewer can extremely enjoy a feeling of release or liberation of the outdoors. In this manner, it is possible to extremely efficiently fulfill various demands which the openable roof apparatus has and which are contrary to each other.

Further, a superior advantage is obtained such as an extremely new or novel openable roof apparatus and so on. That is, such an unexpected sense of beauty is given for a viewer, that, in the viewpoint of design, if the viewing direction changes, an appearance configuration changes little by little.

Preferably, each of the first movable roof section and the second swing roof section is generally semi-circular in plan having a semi-circular bow and a chord connecting both ends of the semi-circular bow to each other, so that the movable roof structure is generally circular in plan in the closed position.

With the above arrangement of the invention, the movable roof structure is high in stability in the closed position as compared with the conventional openable roof apparatus in which the movable roof structure is divided into a plurality of roof elements. Further, since driving locations are less in number, drive mechanisms for the driving locations are simple in construction. Moreover, the second swing roof section is moved angularly about the axis of the space and is overlapped with the first movable roof section, and the second swing roof section and the first movable roof section are moved in unison, whereby the movable roof structure is moved between the closed position and the open position. Thus, a leaving space of the movable roof structure can be reduced, and the openable roof apparatus is rational very much.

DETAILED DESCRIPTION

Figure 1:
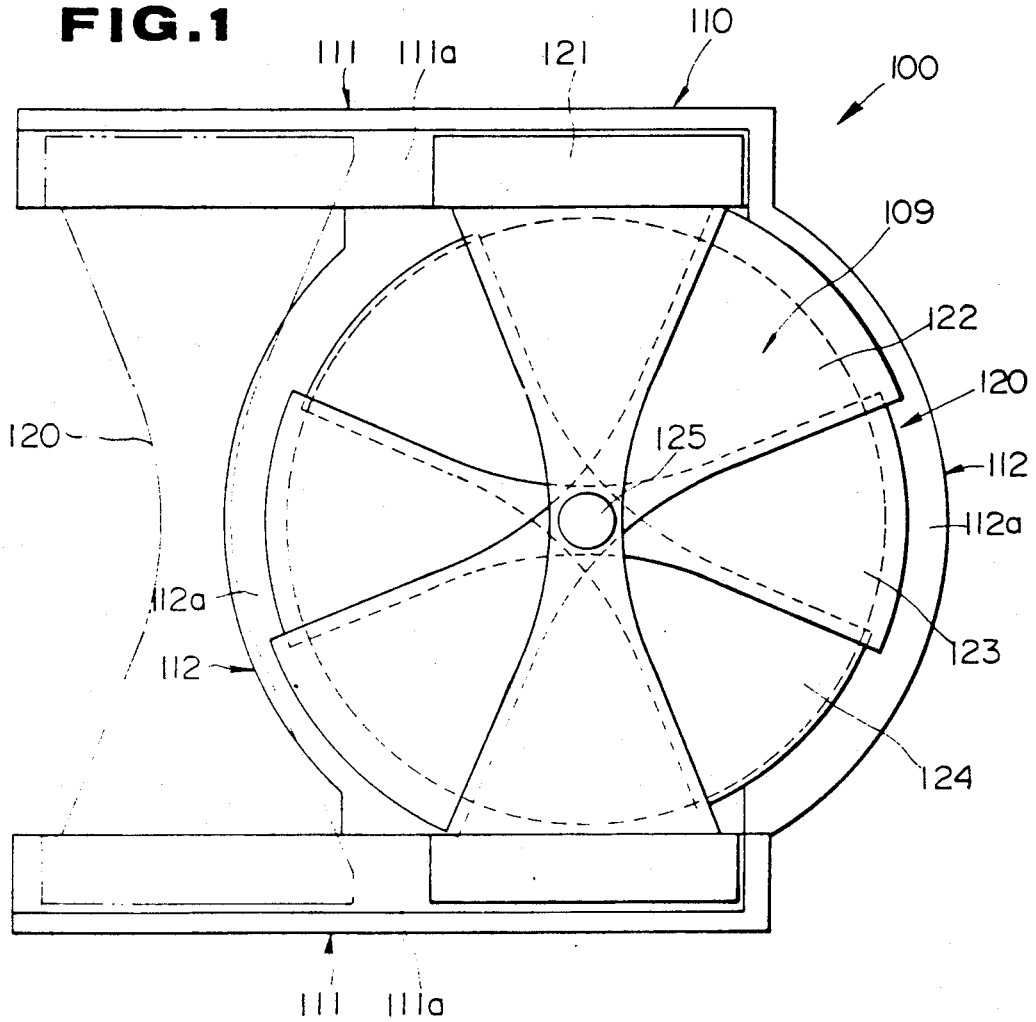
FIG. 1 is a top plan view of an openable roof apparatus according to a first embodiment of the invention, showing a movable roof structure moved to a closed position.

Referring first to FIGS. 1 through 4, there is shown an openable roof apparatus, generally designated by the reference numeral 100, according to a first embodiment of the invention. The openable roof apparatus 100 is applied to a large space S such as, for example, a baseball stadium, which is substantially circular in plan.

Figure 2:
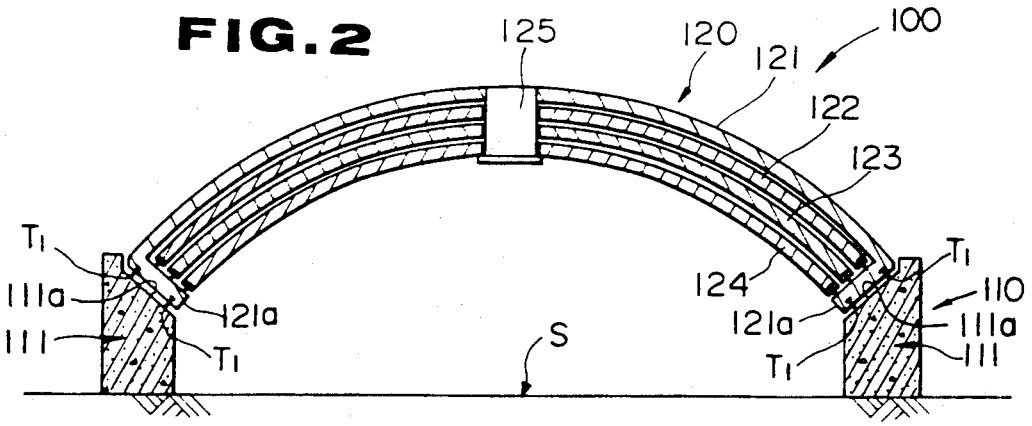
FIG. 2 is a cross-sectional view of the openable roof apparatus illustrated in FIG. 1, showing the movable roof structure moved in an intermediate position.

As shown in FIG. 1, the openable roof apparatus 100 comprises a stationary support structure 110 arranged about the space S, and a movable roof structure 120 which is supported by the stationary support structure 110 and which is movable with respect thereto horizontally. The movable roof structure 120 has a first. Movable roof section 121 and a second swing roof section 109. The second swing roof section 109 comprises at least two, that is, three in the illustrated embodiment, swing roof units 122, 123 and 124. The swing roof units 122, 123 and 124 are movable angularly about the central axis of the space S with respect to the first movable roof section 121 and are capable of being overlapped with each other and with the first movable roof section 121 as illustrated in FIG. 2, subsequently to be described.

The stationary roof structure 110 has a pair of parallel support sections 111 and 111 which are arranged respectively on both sides of the space S and which extend in parallel relation to each other. The pair of parallel support sections 111 and 111 have their respective support surfaces 111*a* and 111*a* which are inclined downwardly toward each other, as will be seen from FIG. 2.

Figure 3:
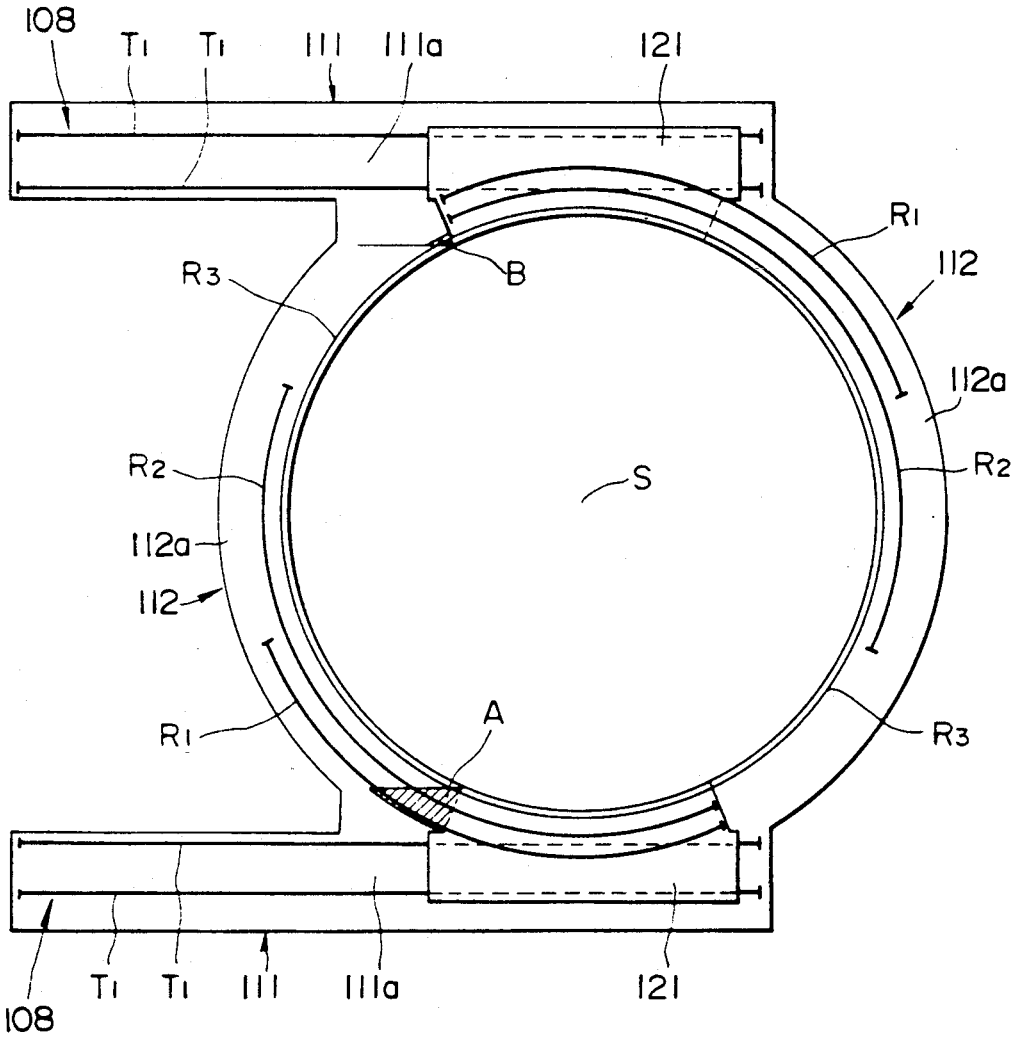
FIG. 3 is a top plan view of a pair of support sections in the openable roof apparatus illustrated in FIG. 1, in which a part of a first movable roof section is omitted from illustration.

As shown in FIG. 3, a pair of guides 108 and 108 are arranged respectively on the support surfaces 111*a* and 111*a* of the respective support sections 111 and 111 and extend perpendicularly to a plane including a central axis of the space S. The first movable roof section 121 and the second swing roof section 109, which are overlapped with each other, are movable along the pair of guides 108 and 108 toward and away from the space S subsequently to be described. The pair of guides 108 and 108 have their respective pairs of straight rails $T_1$ and $T_1$ which are arranged respectively on the support surfaces 111*a* and 111*a* of the respective parallel support sections 111 and 111. The first movable roof section 121 has its both ends which are mounted respectively on the two pairs of straight rails $T_1$ and $T_1$ for movement therealong. Each pair of straight rails $T_1$ and $T_2$ extend horizontally and straight on a corresponding one of the support surfaces 111*a* and 111*a* of the respective parallel support sections 111 and 111.

Referring back to FIG. 1, the stationary roof structure 110 further has a pair of arcuate support sections 112 and 112 which are arranged respectively on both sides of the space S and which extend between the pair of parallel support sections 111 and 111 in facing relation to each other. The pair of arcuate support sections 112 and 112 have their respective support surfaces 112*a* and 112*a* which are inclined downwardly toward each other. As illustrated in FIG. 3, three pairs of arcuate rails $R_1$, $R_2$ and $R_3$ are mounted respectively on the support surfaces 112*a* and 112*a* of the respective arcuate support sections 112 and 112. The pair of arcuate support sections 112 and 112 cooperate with each other to define a circle inscribing the pair of parallel support sections 111 and 111.

The movable roof structure 120 is movable among a closed position illustrated in FIG. 1 where the first movable roof section 121 and the swing roof sections 122, 123 and 124 of the second swing roof section 109 cooperate with each other to close the space S, an intermediate position illustrated in FIG. 2 where the swing roof units 122, 123 and 124 are moved angularly about the central axis of the space S and are overlapped with each other and with the first movable roof section 121 to partially open the space S, and an open position where the first movable roof section 121 and the swing roof units 122, 123 and 124, which are overlapped with each other in the intermediate position, are moved along the pair of guides 108 and 108 away from the space S to open the same. Each of the first movable roof section 121 and the swing roof units 122, 123 and 124 of the second swing roof section 109 is in the form of an arch in cross-section so that, in the closed position, the movable roof structure 120 is in the form of a dome in plan which is convex upwardly.

As described previously, the second swing roof section 109 comprises the three swing roof units 122, 123 and 124. The swing roof units 122, 123 and 124 have their respective both ends which are mounted respectively on the three pairs of arcuate rails $R_1$, $R_2$ and $R_3$ for movement therealong. The three swing roof units 122, 123 and 124 are the same in internal angle as each other and as the first movable roof section 121. In the intermediate position, the swing roof units 122, 123 and 124 are overlapped with each other and with the first movable roof section 121 in a laminated manner. That is, in the intermediate position, the swing roof units 122, 123 and 124 are overlapped with the first movable roof section 121 at a location on the inside of the latter.

As mentioned above, the three pairs of arcuate rails $R_1$, $R_2$ and $R_3$ are arranged respectively on the pair of arcuate support sections 112 and 112. The three pairs of arcuate rails $R_1$, $R_2$ and $R_3$ extend horizontally and arcuately respectively on the support surfaces 112*a* and 112*a* of the respective arcuate support sections 112 and 112. The pairs of arcuate rails $R_1$, $R_2$ and $R_3$ on the respective arcuate support sections 112 and 112 correspond in number to the swing roof units 122, 123 and 124.

As described above, each of the first movable roof section 121 and the three swing roof units 122, 123 and 124 is in the form of a butterfly centering about the central axis of the space S in plan as illustrated in FIG. 1, and has an arch cross-sectional configuration as illustrated in FIG. 2. That is, the first movable roof section 121 has its both ends which are supported respectively by the two pairs of straight rails $T_1$ and $T_1$ for horizontal movement therealong. Each of the swing roof units 122, 123 and 124 of the second swing roof section 109 has its both ends which are supported respectively by a corresponding one of the three pairs of arcuate rails $R_1$, $R_2$ and $R_3$ such that the swing roof units 122, 123 and 124 are movable angularly about the central axis of the space S. Accordingly, the arcuate rails $R_1$, $R_2$ and $R_3$ are located above the straight rails $T_1$ and $T_1$.

Figure 4:
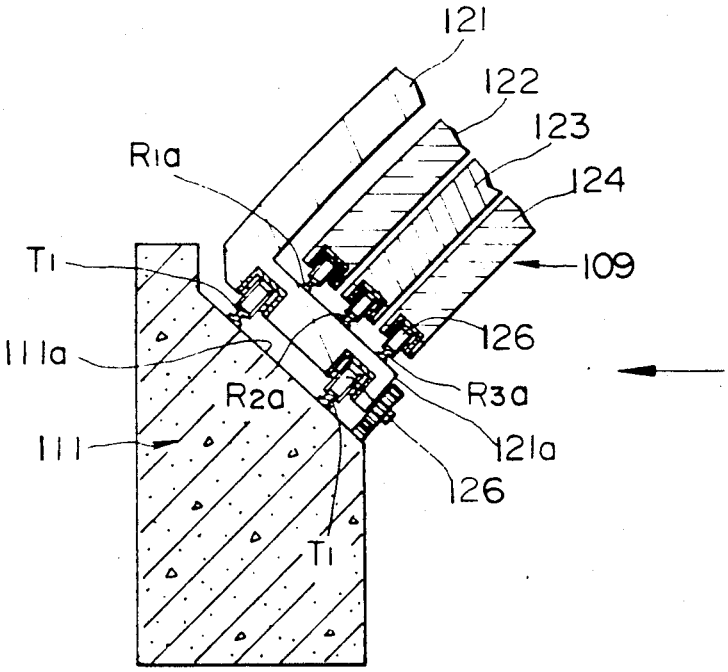
FIG. 4 is an enlarged fragmentary view of various rails of the openable roof apparatus illustrated in FIGS. 2 and 3.

As shown in FIG. 2, the first movable roof section 121 has its both ends 121*a* and 121*a* which are bent inwardly in an L-shape along the support surfaces 111*a* and 111*a* with respect to the remaining body of the first movable roof section 121. As shown in FIG. 4, each of the L-shaped ends 121*a* and 121*a* of the first movable roof section 121 has three arcuate rail sections $R_{1a}$, $R_{2a}$ and $R_{3a}$ for supporting corresponding ones of the both ends of the respective swing roof units 122, 123 and 124. The arcuate rail sections $R_{1a}$, $R_{2a}$ and $R_{3a}$ are the same in level as the three pairs of arcuate rails $R_1$, $R_2$ and $R_3$ on the respective arcuate support sections 112 and 112 so that the swing roof units 122, 123 and 124 can be moved to and from the arcuate rail sections $R_{1a}$, $R_{2a}$ and $R_{3a}$ and the three pairs of arcuate rails $R_1$, $R_2$ and $R_3$. The L-shaped ends 121*a* and 121*a* of the first movable roof section 121 are bent toward each other, and are located below the remaining body of the first movable roof section 121.

As illustrated in FIGS. 1 and 2, a vertical central shaft 125 is provided by which a central top of the first movable roof section 121 is connected to central tops of the respective swing roof units 122, 123 and 124 such that the centers of the respective swing roof units 122, 123 and 124 do not slip from each other. In the intermediate position, the central top of the first movable roof section 121 is in agreement with a center of the space S. Thus, since each of the swing roof units 122, 123 and 124 are formed into the arch cross-sectional configuration, it is designed that a vertical load is not supported by the vertical central shaft 125.

A pair of area A and B shown in FIG. 3 will be described. As illustrated in FIG. 2, when the swing roof units 122, 123 and 124 stored in a laminated manner within the first movable roof section 121 are moved straight along the pair of support sections 111 and 111, the arcuate rails $R_1$, $R_2$ and $R_3$ laid above the straight rails $T_1$ and $T_2$ are an obstacle to the movement of the swing roof units 122, 123 and 124. Accordingly, like a so-called point switch for a railway, elevating mechanisms (not shown) are arranged for supporting sections of the arcuate rails $R_1$, $R_2$ and $R_3$, which are located at the areas A and B and which are an obstacle to the movement of the swing roof units 122, 123 and 124. The elevating mechanisms move the sections of the arcuate rails $R_1$, $R_2$ and $R_3$ to a location lower than the straight rails $T_1$ and $T_1$. Further, although not particularly shown in FIGS. 1 through 4, each of the first movable roof section 121 and the swing roof units 122, 123 and 124, which cooperate with each other to form the movable roof structure 120, is provided with drive mechanisms having wheels 126 (refer to FIG. 4) for enabling the first movable roof section 121 and the swing roof units 122, 123 and 124 to transport along their respective rails in a self-propelled manner.

The operation of the openable roof apparatus 100 constructed as above will be described below.

FIG. 1 shows the closed position of the movable roof structure 120. In the closed position, the first movable roof section 121 is located immediately above the space S, and the swing roof units 122, 123 and 124 are moved to their respective closed positions along their respective arcuate rails $R_1$, $R_2$ and $R_3$. Thus, the top of the space S is closed by the movable roof structure 120.

On the other hand, in order to move the movable roof structure 120 from the closed position to the intermediate position, the swing roof units 122, 123 and 124 are moved angularly about the central axis of the space S in a direction opposite to that in which the movable roof structure 120 is closed, and are overlapped with the first movable roof section 121 on the inside thereof in a laminated manner. At this time, the elevating mechanisms move the sections of the arcuate rails $R_1$, $R_2$ and $R_3$, which are located at the areas A and B, to the position lower than the straight rails $T_1$ and $T_1$. Under this condition, the first movable roof section 121 is moved, together with the swing roof units 122, 123 and 124, laterally along the straight rails $T_1$ and $T_1$, that is, away from the space S. When the first movable roof section 121 is moved to a position indicated by the double dotted lines in FIG. 1, the movable roof structure 120 is moved to the open position where the top of the space S is fully open. In this connection, if it is desired to move the movable roof structure 120 from the open position to the closed position, the order of procedure should be taken which is opposite or reverse to that described above.

According to the first embodiment, the movable roof structure 120 in the form of a dome are divided into four elements each in the form of a butterfly in plan. Of the four elements, the three swing roof units 122, 123 and 124 are moved angularly about the central axis of the space S horizontally along the three pairs of arcuate rails $R_1$, $R_2$ and $R_3$ which are provided respectively on the arcuate support sections 112 and 112. Further, the swing roof units 122, 123 and 124 are stored within the first movable roof section 121 which is the remaining one element and which is moved straight and horizontally along the two pairs of straight rails $T_1$ and $T_1$ provided respectively on the parallel support sections 111 and 111. Under this condition, the four elements, that is, the first movable roof section 121 and the swing roof sections 122, 123 and 124 are moved in unison straight and horizontally. By this simple system, the upper portion of the large space S is open 100%.

Moreover, since all of the first movable roof structure 121 and the swing roof units 122, 123 and 124, which cooperate with each other to form the movable roof structure 120, have the both-end-supported arch-shaped cross-sectional configuration, the openable roof apparatus 100 can be designed at low cost as compared with an arch-shaped arrangement having cantilever beams or supported by a post which is located at a center of angular movement of movable roof units. Thus, the openable roof apparatus 100 is reduced in weight correspondingly, and the cost is reduced.

Furthermore, the first movable roof section 121 and the three swing roof units 122, 123 and 124, which cooperate with each other to form the dome-shaped movable roof structure 120, are moved straight, and the three swing roof units 122, 123 and 124 are moved angularly about the central axis of the space S. Accordingly, the openable roof apparatus 100 is extremely new or novel in design. Thus, such an advantage is also created that a viewer has a foreboding of an unexpected function.

In the first embodiment illustrated in FIGS. 1 through 4, the openable roof apparatus 100 comprises the dome-shaped movable roof structure 120 which is formed by the first movable roof section 121 and the three swing roof sections 122, 123 and 124. It is needless to say, however, that the movable roof structure may comprise two, or four or more swing roof units.

Figure 5:
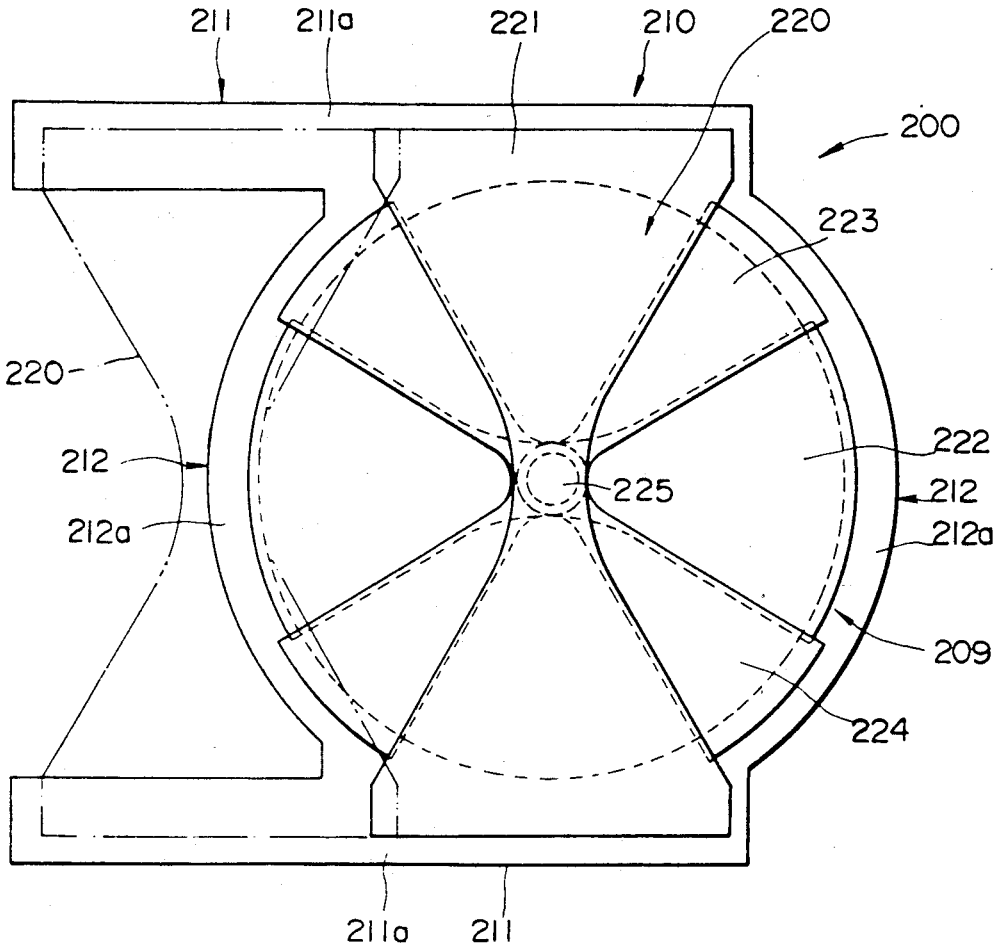
FIG. 5 is a top plan view of an openable roof apparatus according to a second embodiment of the invention, showing a movable roof structure moved to a closed position.

Referring next to FIGS. 5 through 8, there is shown an openable roof apparatus, generally designated by the reference numeral 200, according to a second embodiment of the invention. The openable roof apparatus 200 is applied to a large space S such as, for example, a baseball stadium, which is substantially circular in plan, similarly to the first embodiment described previously with reference to FIGS. 1 through 4. As shown in FIG. 5, the openable roof apparatus 200 comprises a stationary support structure 210 and a movable roof structure 220. The movable roof structure 220 comprises a first movable roof section 221 and a second swing roof section 209. The second swing roof section 209 is composed of a main swing roof unit 222 and a pair of subsidiary roof units 223 and 224.

The stationary roof structure 210 has a pair of parallel support sections 211 and 211 which are arranged respectively on both sides of the space S and which extend in parallel relation to each other. The stationary roof structure 210 further has a pair of arcuate support sections 212 and 212 which are arranged respectively on both sides of the space and which extend between the pair of parallel support sections 211 and 211 in facing relation to each other.

Figure 6:
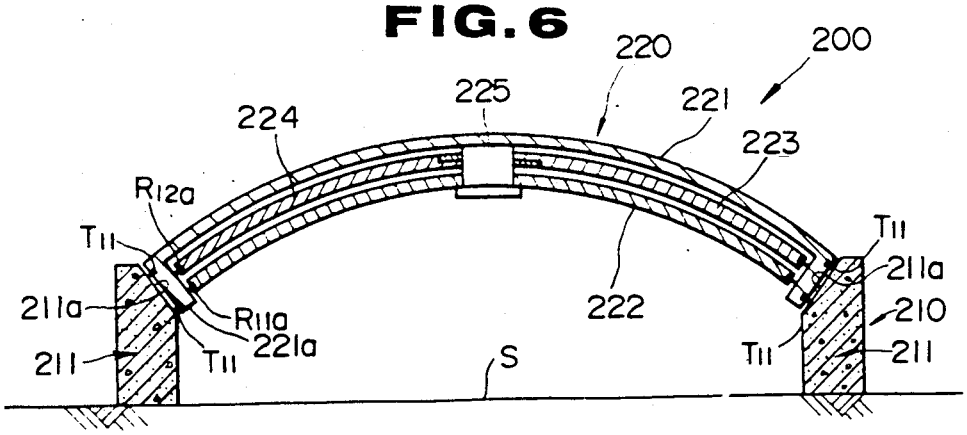
FIG. 6 is a cross-sectional view of the openable roof apparatus illustrated in FIG. 5, showing the movable roof structure moved in an intermediate position.

The pair of parallel support sections 211 and 211 have their respective support surfaces 211*a* and 211*a* which are inclined downwardly toward each other, as will be seen from FIG. 6. Further, the pair of arcuate support sections 212 and 212 have their respective support surfaces 212*a* and 212*a* which are inclined downwardly toward each other.

Figure 7:
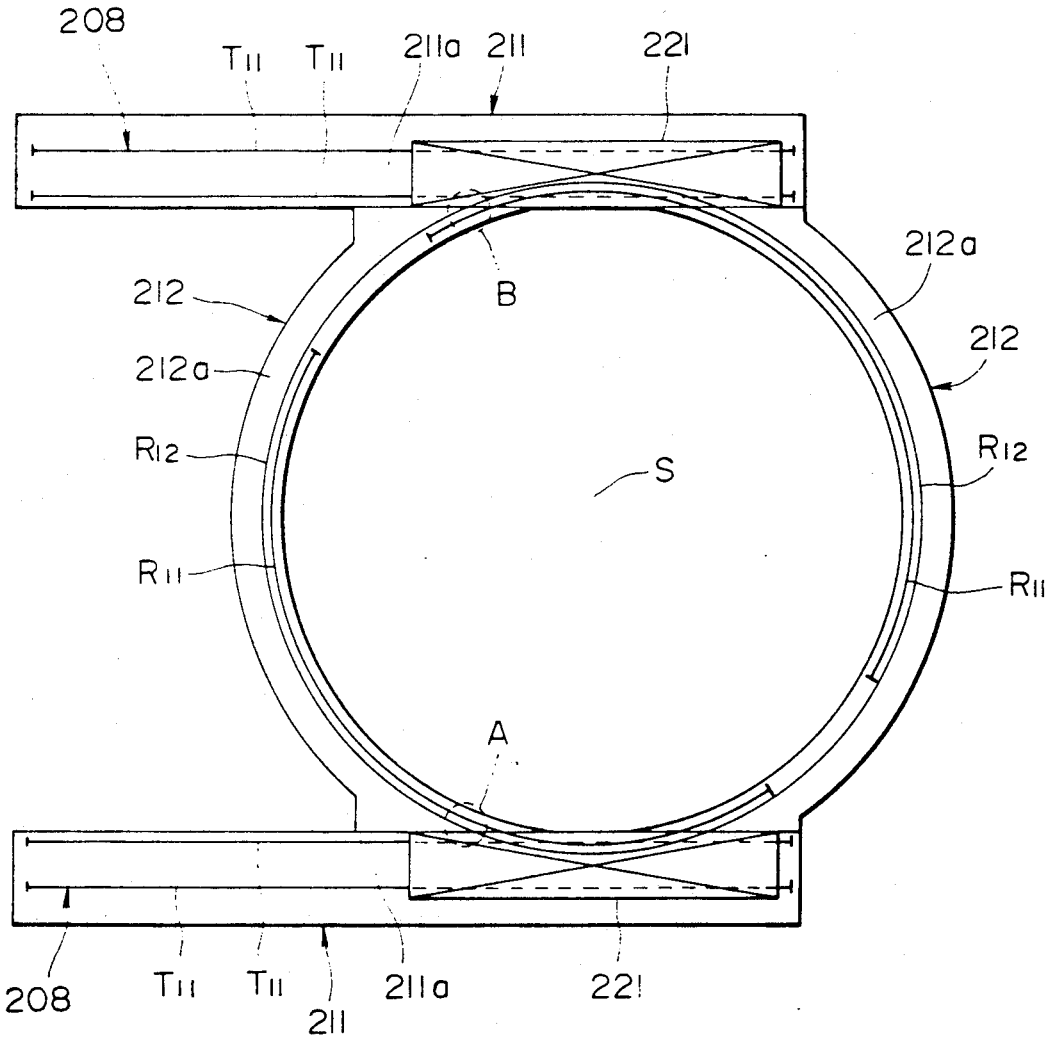
FIG. 7 is a top plan view of a pair of support sections in the openable roof apparatus illustrated in FIG. 5, in which a part of a first movable roof section is omitted from illustration.

As shown in FIG. 7, a pair of guides 208 and 208 are arranged respectively on the support surfaces 211*a* and 211*a* of the respective support sections 211 and 211 and extend perpendicularly to a plane including a central axis of the space S. The first movable roof section 221 and the second swing roof section 209, which are overlapped with each other, are movable along the pair of guides 208 and 208 toward and away from the space S subsequently to be described. The pair of guides 208 and 208 have their respective pairs of straight rails $T_{11}$ and $T_{11}$ which are arranged respectively on the support surfaces 211*a* and 211*a* of the respective parallel support sections 211 and 211. The first movable roof section 221 has its both ends which are mounted respectively on the two pairs of straight rails $T_{11}$ and $T_{11}$ for movement therealong. Each pair of straight rails $T_{11}$ and $T_{11}$ extend horizontally and straight on a corresponding one of the support surfaces 211*a* and 211*a* of the respective parallel support sections 211 and 211. The pair of arcuate support sections 212 and 212 cooperate with each other to define a circle inscribing the pair of parallel support sections 211 and 211.

Further, as illustrated in FIG. 7, two pairs of arcuate rails $R_{11}$ and $R_{12}$ are mounted respectively on the support surfaces 212*a* and 212*a* of the respective arcuate support sections 212 and 212.

Similarly to the first embodiment described above with reference to FIGS. 1 through 4, the movable roof structure 220 is movable among a closed position illustrated in FIG. 5 where the first movable roof section 221 and the main and subsidiary swing roof sections 222, 223 and 224 of the second swing roof section 209 cooperate with each other to close the space S, an intermediate position illustrated in FIG. 6 where the main and subsidiary swing roof units 222, 223 and 224 are moved angularly about the central axis of the space S and are overlapped with each other and with the first movable roof section 221 to partially open the space S, and an open position where the first movable roof section 221 and the main subsidiary swing roof units 222, 223 and 224, which are overlapped with each other in the intermediate position, are moved along the pair of guides 208 and 208 away from the space S to open the same.

The movable roof structure 220 comprises the four movable roof elements each of which has a butterfly configuration in plan centering around a vertical central axis of the space S as shown in FIG. 5, and which has an arch cross-sectional configuration as shown in FIG. 6. That is, the movable roof structure 220 comprises the first movable roof section 221 and the second swing roof section 209 which is composed of the main swing roof unit 222 and the pair of subsidiary swing roof units 223 and 224. The main swing roof unit 222 and the pair of subsidiary swing roof units 223 and 224 have their respective both ends which are mounted respectively on the two pairs of arcuate rails $R_{11}$ and $R_{12}$ for movement therealong. In the intermediate position, the main swing roof unit 222 and the pair of subsidiary swing roof units 223 and 224, which are overlapped with the main swing roof unit 222 and with the first movable roof section 221, are located on the inside of the latter. That is, in the intermediate position, the pair of subsidiary swing roof units 223 and 224 are located between the main swing roof unit 222 and the first movable roof section 221 in side-by-side relation to each other, and the main swing roof unit 222 is overlapped with the pair of subsidiary swing roof units 223 and 224 and with the first movable roof section 221 in a laminated manner. Accordingly, the circular rails $R_{11}$ and $R_{12}$ are located above the straight rails $T_{11}$ and $T_{12}$.

In the closed position, the main swing roof unit 222 has its axis which extends perpendicularly to that of the first movable roof section 221.

The first movable roof section 221 and the main swing roof unit 222 have their respective internal angles each of which is of the order of approximately 60° in plan, and are substantially the same in configuration as each other. The pair of subsidiary swing roof units 223 and 224 are of such size that the two subsidiary swing roof units 223 and 224 form the single main swing roof unit 223 or the single first movable roof section 221. That is, each of the subsidiary swing roof units 223 and 224 has its internal angle of the order of approximately 30°.

Figure 8:
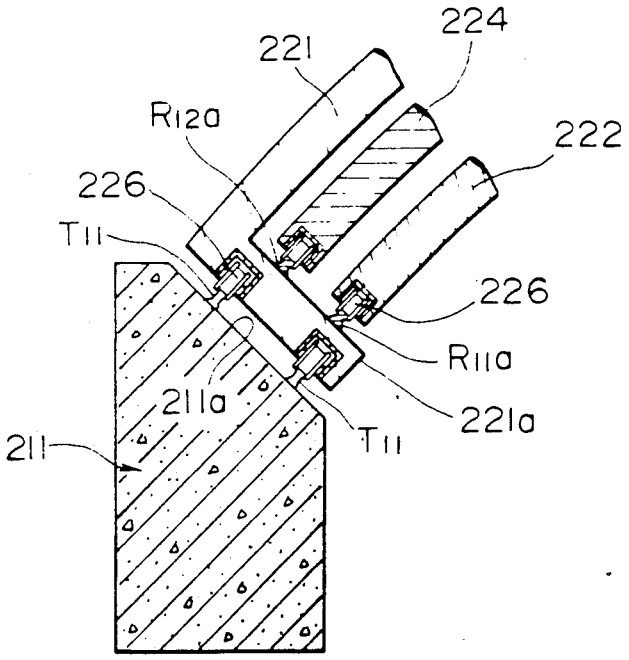
FIG. 8 is an enlarged fragmentary view of various rails of the openable roof apparatus illustrated in FIGS. 6 and 7.

As shown in FIG. 6, the first movable roof section 221 has its both ends 221*a* and 221*a* which are bent inwardly in an L-shape along the support surfaces 211*a* and 211*a* with respect to the remaining body of the first movable roof section 221. As shown in FIG. 8, each of the L-shaped ends 221*a* and 221*a* of the first movable roof section 221 has two arcuate rail sections $R_{11a}$ and $R_{12a}$ for supporting corresponding ones of the both ends of the respective swing roof units 222, 223 and 224. The arcuate rail sections $R_{11a}$ and $R_{12a}$ are the same in level as the two pairs of arcuate rails $R_{11}$ and $R_{12}$ on the respective arcuate support sections 212 and 212 so that the main and subsidiary swing roof units 222, 223 and 224 can be moved to and from the arcuate rail sections $R_{11a}$ and $R_{12a}$ and the two pairs of arcuate rails $R_{11}$ and $R_{12}$. The L-shaped ends 221*a* and 221*a* of the first movable roof section 221 are bent toward each other, and are located below the remaining body of the first movable roof section 221.

As illustrated in FIGS. 5 and 6, a vertical central shaft 225 is provided adjacent a central top of the first movable roof section 221. By the central shaft 225, central tops of the respective main and subsidiary swing roof units 222, 223 and 224 are connected to each other such that the centers of the respective main and subsidiary swing roof units 222, 223 and 224 do not slip from each other. In the intermediate position, the central top of the first movable roof section 221 is in agreement with a center of the space S. Thus, since each of the main and subsidiary swing roof units 222, 223 and 224 are formed into the arch-shaped cross-sectional configuration, it is designed that a vertical load is not supported by the vertical central shaft 225.

Similarly to the first embodiment described with reference to FIGS. 1 through 4, like a so-called point switch for a railway, elevating mechanisms (not shown) are arranged, as illustrated in FIG. 7, for supporting sections of the circular rails $R_{11}$ and $R_{12}$, which are located at a pair of areas A and B and which are an obstacle to the straight movement of the movable roof structure 220 under such a condition that the subsidiary swing roof units 223 and 224 are stored in a two-stage manner between the first movable roof section 221 and the main swing roof unit 222. The elevating mechanisms also move the sections of the circular rails $R_{11}$ and $R_{12}$ to a location lower than the straight rails $T_{11}$ and $T_{11}$. Further, although not particularly shown in FIGS. 5 through 8, each of the first movable roof section 221 and the main and sibsidiary swing roof units 222, 223 and 224 is provided with drive mechanisms having wheels 226 (refer to FIG. 8) for enabling the first movable roof section 221 and the main and subsidiary swing roof units 222, 223 and 234 to transport along their respective rails in a self-propelled manner. The operation of the openable roof apparatus 200 according to the second embodiment, which is constructed as above, will be described below.

FIG. 5 shows the closed position of the movable roof structure 220. In the closed position, the first movable roof section 221 is located immediately above the space S. The main swing roof unit 222 is moved angularly about the central axis of the space S by approximately 90° in the clockwise direction with respect to the first movable roof section 221 along the circular rails $R_{11}$. The two subsidiary swing roof units 223 and 224 are moved to their respective closed positions along their common circular rail $R_{12}$. Thus, the top of the space S is closed by the movable roof structure 220.

On the other hand, in order to move the movable roof structure 220 from the closed position to the intermediate position, the main swing roof unit 222 and the subsidiary swing roof units 223 and 224 are moved angularly about the central axis of the space S in a direction opposite to that in which the movable roof structure 220 is closed, and are overlapped with the first movable roof section 221 in a two-stage manner, as shown in FIG. 6. At this time, if necessary, the elevating mechanisms move the sections of the circular rails $R_{11}$ and $R_{12}$, which are located in the areas A and B, to the position lower than the straight rails $T_{11}$ and $T_{11}$. Under this condition, the first movable roof section 221 are moved, together with the main and subsidiary swing roof units 222, 223 and 224, laterally along the straight rails $T_{11}$ and $T_{11}$, that is, away from the space S. When the first movable roof section 221 is moved to a position indicated by the movable roof structure 220 is moved to the open position where the top of the space S is fully open. In this connection, if it is desired to move the movable roof structure 220 from the open position to the closed position, the order of procedure should be taken which is opposite or reverse to that described above.

According to the second embodiment, the movable roof structure 220 in the form of a dome are divided into four elements each in the form of a butterfly in plan. Of the four elements, the three main and subsidiary swing roof units 222, 223 and 224 are moved angularly about the central axis of the space S horizontally along the two pairs of circular rails $R_{11}$ and $R_{12}$ which are provided respectively on the arcuate support sections 212 and 212. Further, the main and subsidiary swing roof units 222, 223 and 224 are stored within the first movable roof section 221 which is the remaining one element and which is moved straight and horizontally along the two pairs of straight rails $T_{11}$ and $T_{11}$ provided respectively on the parallel support sections 211 and 211. Under this condition, the four elements, that is, the first movable roof section 221 and the main and subsidiary swing roof sections 222, 223 and 224 are moved in unison straight and horizontally. By this simple system, the upper portion of the large space S is open 100%.

Moreover, since all of the first movable roof structure 221 and the main and subsidiary swing roof units 222, 223 and 224, which cooperate with each other to form the movable roof structure 220, have the both-end-supported arch-shaped cross-sectional configuration, the openable roof apparatus 200 can be designed at low cost as compared with an arch-shaped roof arrangement having cantilever beams or supported by a post which is located at a center of angular movement of movable roof units. Thus, the openable roof apparatus 200 is reduced in weight correspondingly, and the cost is reduced.

Furthermore, the first movable roof section 221 and the three main and subsidiary swing roof units 222, 223 and 224, which cooperate with each other to form the dome-shaped movable roof structure 220, are moved straight, and the three main and subsidiary swing roof units 222, 223 and 224 are moved angularly about the central axis of the space S. Accordingly, the openable roof apparatus 200 is extremely new or novel in design. Thus, such an advantage is also created that a viewer has a foreboding of an unexpected function.

Similarly to the first embodiment described with reference to FIGS. 1 through 4, it is of course that the movable roof structure may comprise two, or four or more swing roof units.

Referring next to FIGS. 9 through 14, there is shown an openable roof apparatus, generally designated by the reference numeral 300, according to a third embodiment of the invention. The openable roof apparatus 300 is applied to a large space S such as, for example, a baseball stadium, which is substantially circular in plan, similarly to the first embodiment described previously with reference to FIGS. 1 through 4.

Figure 9:
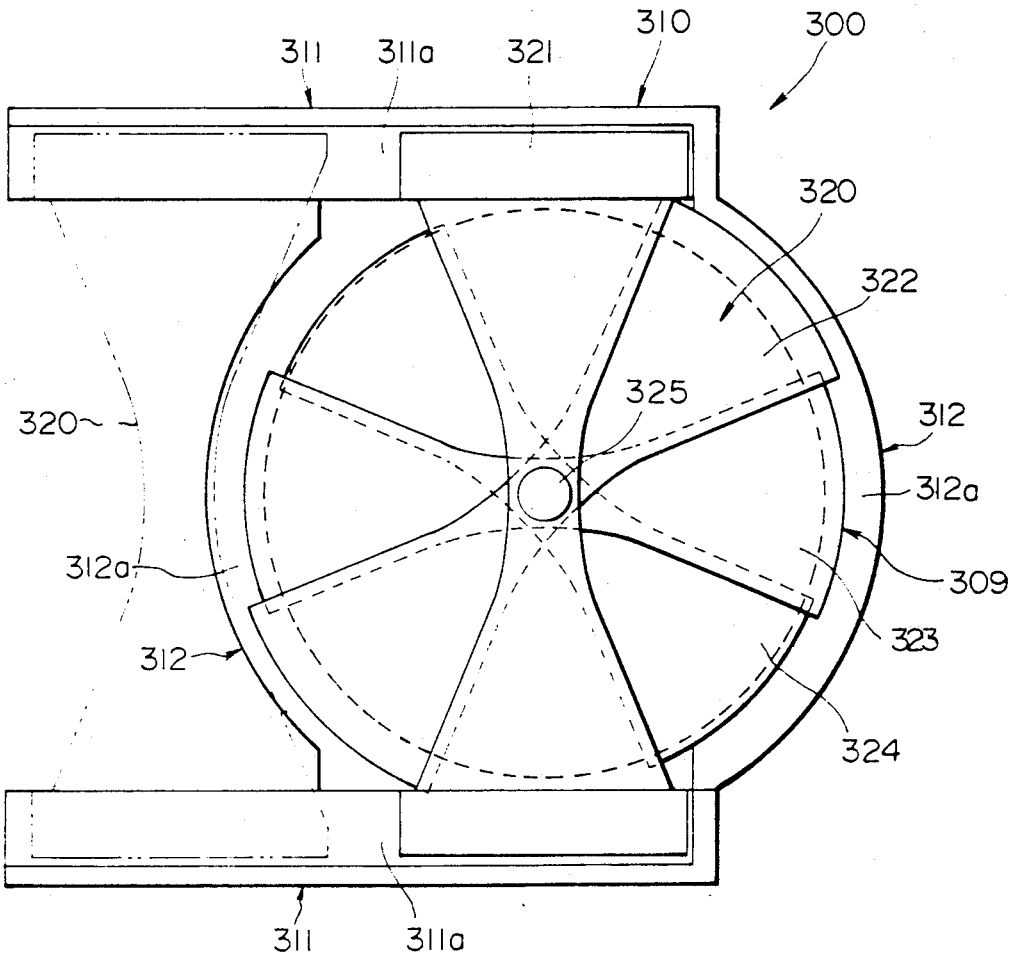
FIG. 9 is a top plan view of an openable roof apparatus according to a third embodiment of the invention, showing a movable roof structure moved to a closed position.

Referring first to FIG. 9, the openable roof apparatus 300 comprises a stationary support structure 310 and a movable roof structure 320. The movable roof structure 320 comprises a first movable roof section 321 and a second swing roof section 309. The second swing roof section 309 is composed of three swing roof units 322, 323 and 324.

The stationary roof structure 310 has a pair of parallel support sections 311 and 311 which are arranged respectively on both sides of the space S and which extend in parallel relation to each other. The stationary roof structure 310 further has a pair of arcuate support sections 312 and 312 which are arranged respectively on both sides of the space and which extend between the pair of parallel support sections 311 and 311 in facing relation to each other.

Figure 10:
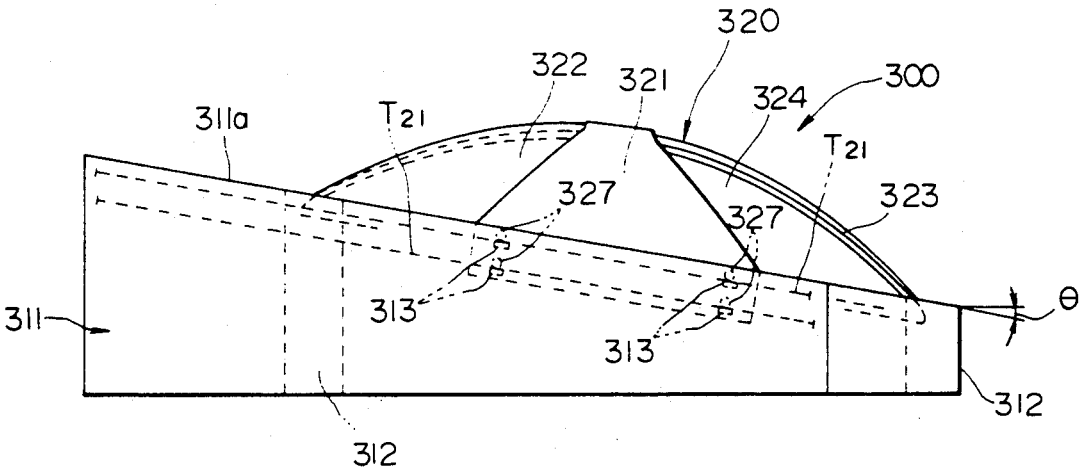
FIG. 10 is a side elevational view of the openable roof apparatus illustrated in FIG. 9.

As shown in FIG. 10, the parallel support sections 311 and 311 have their respective support surfaces **311*a* and 311*a* which are inclined toward each other and which are inclined with respect to a horizontal plane. That is, the support surfaces 311*a* and 311*a*** are inclined with respect to a horizontal plane upwardly away from the space S at a predetermined angle or gradient B.

Figure 12:
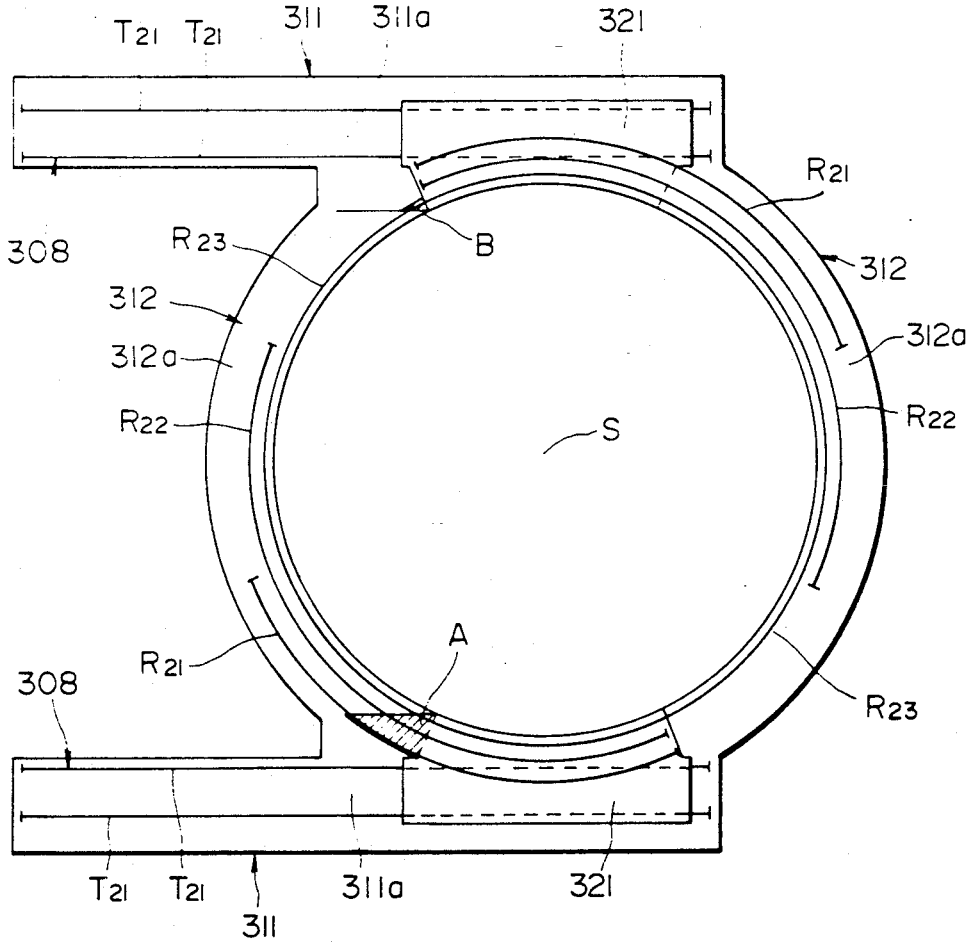
FIG. 12 is a top plan view of a pair of support sections in the openable roof apparatus illustrated in FIG. 9, in which a part of a first movable roof section is omitted from illustration.

As shown in FIG. 12, a pair of guides 308 and 308 are arranged respectively on the support surfaces **311*a* and 311*a* of the respective support sections 311 and 311 and extend obliquely to a plane including a central axis of the space S. The first movable roof section 321 and the second swing roof section 309, which are overlapped with each other, are movable along the pair of guides 308 and 308 toward and away from the space S subsequently to be described. The pair of guides 308 and 308 have their respective pairs of straight rails $T_{21}$ and $T_{21}$ which are arranged respectively on the support surfaces 311***a* and 311*a* of the respective parallel support sections 311 and 311. The first movable roof section 321 has its both ends which are mounted respectively on the two pairs of straight rails $T_{21}$ and $T_{21}$ for movement therealong. Each pair of straight rails $T_{21}$ and $T_{21}$ extend obliquely and straight on a corresponding one of the support surfaces 311*a* and 311*a* of the respective parallel support sections 311 and 311. The pair of arcuate support sections 312 and 312 cooperate with each other to define a circle inscribing the pair of parallel support sections 311 and 311.

Figure 13:
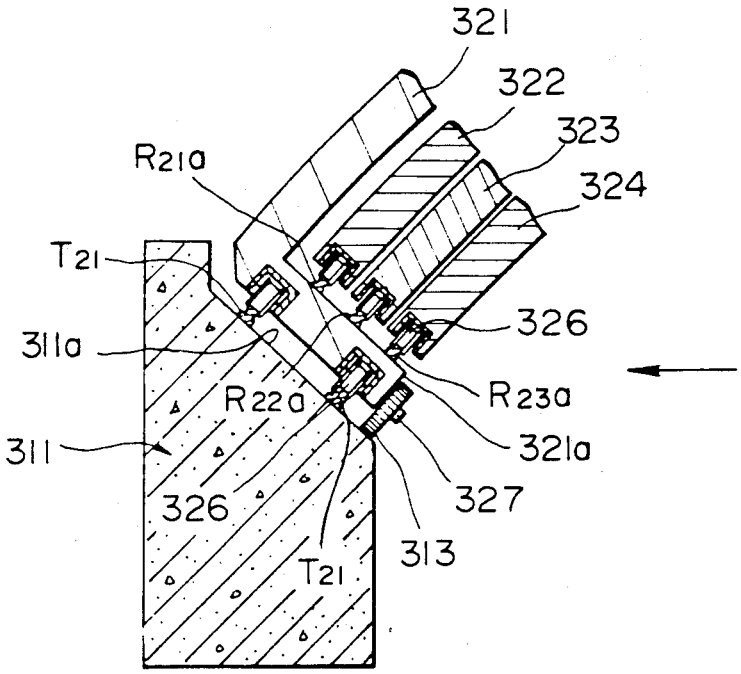
FIG. 13 is an enlarged fragmentary view of various rails of the openable roof apparatus illustrated in FIGS. 11 and 12.
Figure 14:
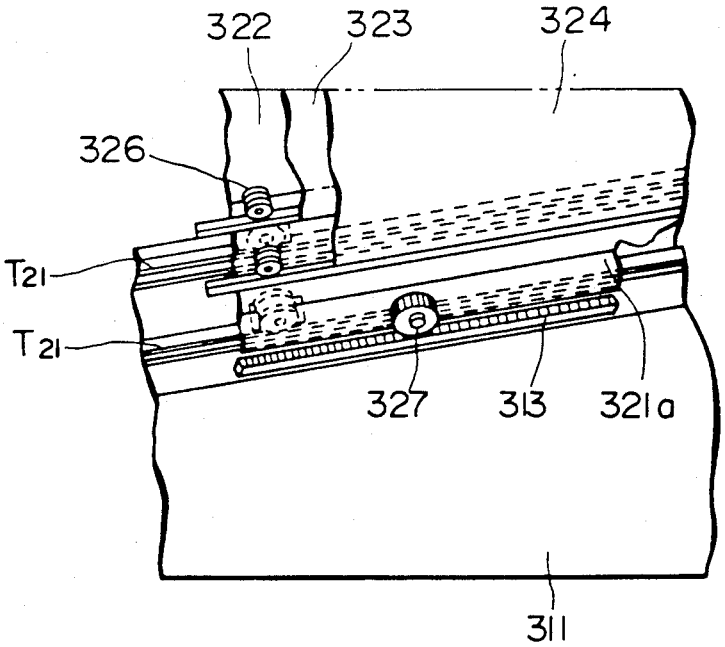
FIG. 14 is a fragmentary front elevational view as viewed from the arrow in FIG. 13.

As illustrated in FIGS. 13 and 14, two pairs of racks 313 (see also to FIG. 10) are arranged on each of the pair of parallel support sections 311 and 311 in parallel with the corresponding pair of inclined straight rails $T_{21}$ and $T_{21}$. Two pairs of pinion gears 327 are arranged on each of the both innermost sides of the first movable roof section 321. The pinion gears 327 are in mesh respectively with the racks 313 to prevent slippage of the first movable roof section 321 at start and stop thereof respectively along the pair of inclined straight rails $T_{21}$ and $T_{21}$ on the pair of parallel support sections 311 and 311.

On the other hand, as shown in FIG. 9, the arcuate support sections 312 and 312 have their respective support surfaces 312*a* and 312*a* which are inclined toward each other and which are inclined in parallel relation to the support surfaces 311*a* and 311*a* of the respective parallel support sections 311 and 311. That is, the support surfaces 312*a* and 312*a* are inclined at the gradient B. As shown in FIG. 12, three pairs of arcuate rails $R_{21}$, $R_{22}$ and $R_{23}$ are provided respectively on the support surfaces 312*a* and 312*a*.

Figure 11:
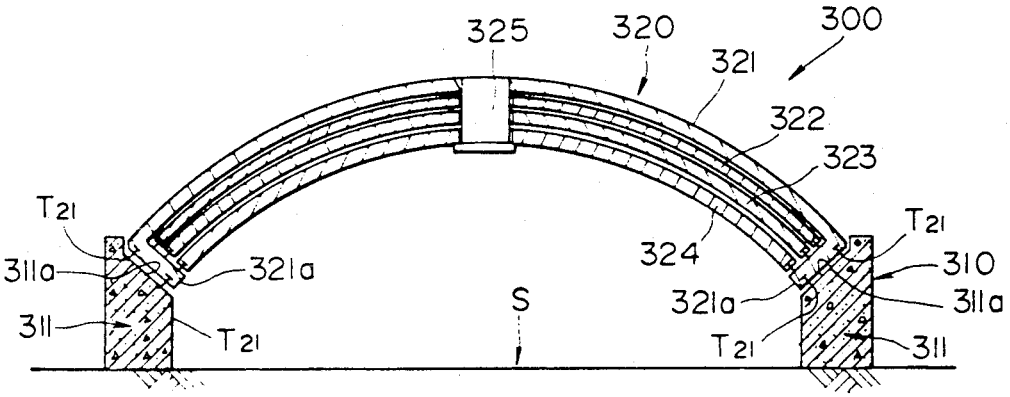
FIG. 11 is a cross-sectional view of the openable roof apparatus illustrated in FIG. 9, showing the movable roof structure moved in an intermediate position.

The movable roof structure 320 is movable among a closed position illustrated in FIG. 9 where the first movable roof section 321 and the swing roof sections 322, 323 and 334 of the second swing roof section 309 cooperate with each other to close the space S, an intermediate position illustrated in FIG. 11 where the swing roof units 322, 323 and 324 are moved angularly about the central axis of the space S and are overlapped with each other and with the first movable roof section 321 to partially open the space S, and an open position where the first movable roof section 321 and the swing roof units 322, 323 and 324, which are overlapped with each other in the intermediate position, are moved along the pair of guides 308 and 308 away from the space S to open the same.

As described previously, the second roof section 320 comprises the four movable roof elements each of which has a butterfly configuration in plan centering around a vertical central axis of the space S as shown in FIG. 9, and which has an arch-shaped cross-sectional configuration as shown in FIG. 10. That is, the movable roof structure 320 comprises the first movable roof section 321 and the second swing roof section 309 which is composed of the three swing roof units 322, 323 and 324. The first movable roof structure 320 has its both ends which are supported respectively by the two pairs of the inclined rails $T_{21}$ and $T_{21}$ for movement therealong. The swing roof units 322, 323 and 324 have their respective both ends which are mounted respectively on the three pairs of arcuate rails $R_{21}$, $R_{22}$ and $R_{23}$ for movement therealong. In the intermediate position, the swing roof units 322, 323 and 324 are overlapped with the first movable roof section 321 in a laminated manner. Accordingly, the circular rails $R_{21}$, $R_{22}$ and $R_{23}$ are located above the straight rails $T_{21}$ and $T_{21}$.

As shown in FIG. 11, the first movable roof section 321 has its both ends 321*a* and 321*a* which are bent inwardly in an L-shape along the support surfaces 311*a* and 311*a* with respect to the remaining body of the first movable roof section 321. As shown in FIG. 13, each of the L-shaped ends 321*a* and 321*a* of the first movable roof section 321 has three arcuate rail sections $R_{21a}$, $R_{22a}$ and $R_{23a}$ for supporting corresponding ones of the both ends of the respective swing roof units 322, 323 and 324. The arcuate rail sections $R_{21a}$, $R_{22a}$ and $R_{23a}$ are the same in level as the three pairs of arcuate rails $R_{21}$, $R_{22}$ and $R_{23}$ on the respective arcuate support sections 312 and 312 so that the swing roof units 322, 323 and 324 can be moved to and from the arcuate rail sections $R_{21a}$, $R_{22a}$ and $R_{23a}$ and the three pairs of arcuate rails $R_{21}$, $R_{22}$ and $R_{23}$. The L-shaped ends 321*a* and 321*a* of the first movable roof section 321 are bent toward each other, and are located below the remaining body of the first movable roof section 321.

As illustrated in FIGS. 9 and 11, a vertical central shaft 325 is provided by which a central top of the first movable roof section 321 is connected to central tops of the respective swing roof units 322, 323 and 324 such that the centers of the respective swing roof units 322, 323 and 324 do not slip from each other. In the intermediate position, the central top of the first movable roof section 321 is in agreement with a center of the space S. Thus, since each of the swing roof units 322, 323 and 324 are formed into the arch-shaped cross-sectional configuration, it is designed that a vertical load is not supported by the swing central shaft 325.

Similarly to the first embodiment described with reference to FIGS. 1 through 4, like a so-called point switch for a railway, elevating mechanisms (not shown) are arranged, as illustrated in FIG. 12, for supporting sections of the circular rails $R_{21}$, $R_{22}$ and $R_{23}$, which are located at a pair of areas A and B and which are an obstacle to the movement of the swing roof units 322, 323 and 324. The elevating mechanisms move the sections of the circular rails $R_{21}$, $R_{22}$ and $R_{23}$ to a location lower than the straight rails $T_{21}$ and $T_{21}$. Further, although not particularly shown in FIGS. 9 through 14, each of the first movable roof section 321 and the swing roof units 322, 323 and 324 is provided with drive mechanisms having wheels 326 (refer to FIGS. 13 and 14) for enabling the first movable roof section 321 and the swing roof units 322, 323 and 334 to transport along their respective rails in a self-propelled manner.

Particularly, the first movable roof section 321 is provided with a pair of drive mechanisms each of which has the pinion gear 327 which is in mesh with the rack 313 on the support surface 311*a*. Thus, slippage of the first movable roof section 321 is prevented at start and stop thereof respectively along the pair of inclined straight rails $T_{21}$ and $T_{21}$ on the pair of parallel support sections 311 and 311.

When the openable roof apparatus 300 constructed as above is applied to a baseball stadium, the radial inner surface of one of the arcuate support sections 312 and 312, which is located at left as viewed in FIG. 9, is formed into the stands behind the backstop, while the radial inner surface of the other arcuate support section 312, which is located at the right as viewed in FIG. 9, is formed into the stands of the outfield. By doing so, it is possible to sufficiently exhibit or display an advantage which the conventional roof-less baseball ground has. That is, when one views downwardly the outfield from the stands behind the backstop, an area in front of the viewer's view breaks open so that the viewer can extremely enjoy a feeling of release or liberation. This advantage cannot at all be enjoyed by the conventional horizontally-movable roof apparatus. The advantage is obtained indeed by such arrangement that the movable roof structure 320 is moved upwardly along the inclined or sloped rails $T_{21}$ and $T_{21}$.

The operation of the openable roof apparatus 300 according to the third embodiment, which is constructed as above, will be described below.

FIG. 9 shows the closed position of the movable roof structure 320. In the closed position, the first movable roof section 321 is located immediately above the space S. The swing roof units 322, 323 and 324 are moved angularly about the central axis of the space S in the clockwise direction with respect to the first movable roof section 321 along the respective circular rails $R_{21}$, $R_{22}$ and $R_{23}$. Thus, the top of the space S is closed movable roof structure 320.

On the other hand, in order to move the movable roof structure 320 from the closed position to the intermediate position, the swing roof units 322, 323 and 324 are moved angularly about the central axis of the space S in a direction opposite to that in which the movable roof structure 320 is closed, and are overlapped with the first movable roof section 321, as shown in FIG. 11. At this time, the elevating mechanisms move the sections of the circular rails $R_{21}$, $R_{22}$ and $R_{23}$, which are located in the areas A and B, to the position lower than the straight rails $T_{21}$ and $T_{21}$. Under this condition, the first movable roof section 321 are moved, together with the swing roof units 322, 323 and 324, laterally upwardly along the inclined straight rails $T_{21}$ and $T_{21}$, that is, away from the space S. When the first movable roof section 321 is moved to a position indicated by the double dotted lines in FIG. 9, the movable roof structure 320 is moved to the open position where the top of the space S is fully open. In this connection, such a disadvantage or malfunction that the first movable roof section 321 is moved backward or retreated does not occur under the action of the racks 313 and the pinion gears 327 on the respective support surfaces 311*a* and 311*a*. As described previously, under this condition, when one views downwardly the outfield of the arcuate support section 312 or the right-hand side as viewed in FIG. 9, from the stands behind the backstop, the viewer can extremely enjoy a feeling of liberation.

In connection with the above, if it is desired to move the movable roof structure 320 from the open position to the closed position, the movable roof structure 320 is moved downwardly to the position on the space S, and the order of procedure should be taken which is opposite or reverse to that described above.

According to the third embodiment described with reference to FIGS. 9 through 14, the following superior advantages are obtained:

(1) The movable roof structure 320 is moved upwardly along the sloped rails $T_{21}$ and $T_{21}$, whereby the space S is fully open 100%. By doing so, as compared with the case where the movable roof structure 320 is moved horizontally, a peculiar advantage can be obtained which is more matched with the roof-less baseball ground.

(2) Since all of the first movable roof structure 321 and the swing roof units 322, 323 and 324, which cooperate with each other to form the movable roof structure 320, have the both-end-supported arch-shaped cross-sectional configuration, the openable roof apparatus can be designed at low cost as compared with an arch-shaped arrangement having cantilever beams or supported by a post which is located at a center of angular movement of movable roof units. Thus, the openable roof apparatus 300 is reduced in weight correspondingly, and the cost is reduced.

Figure 15:
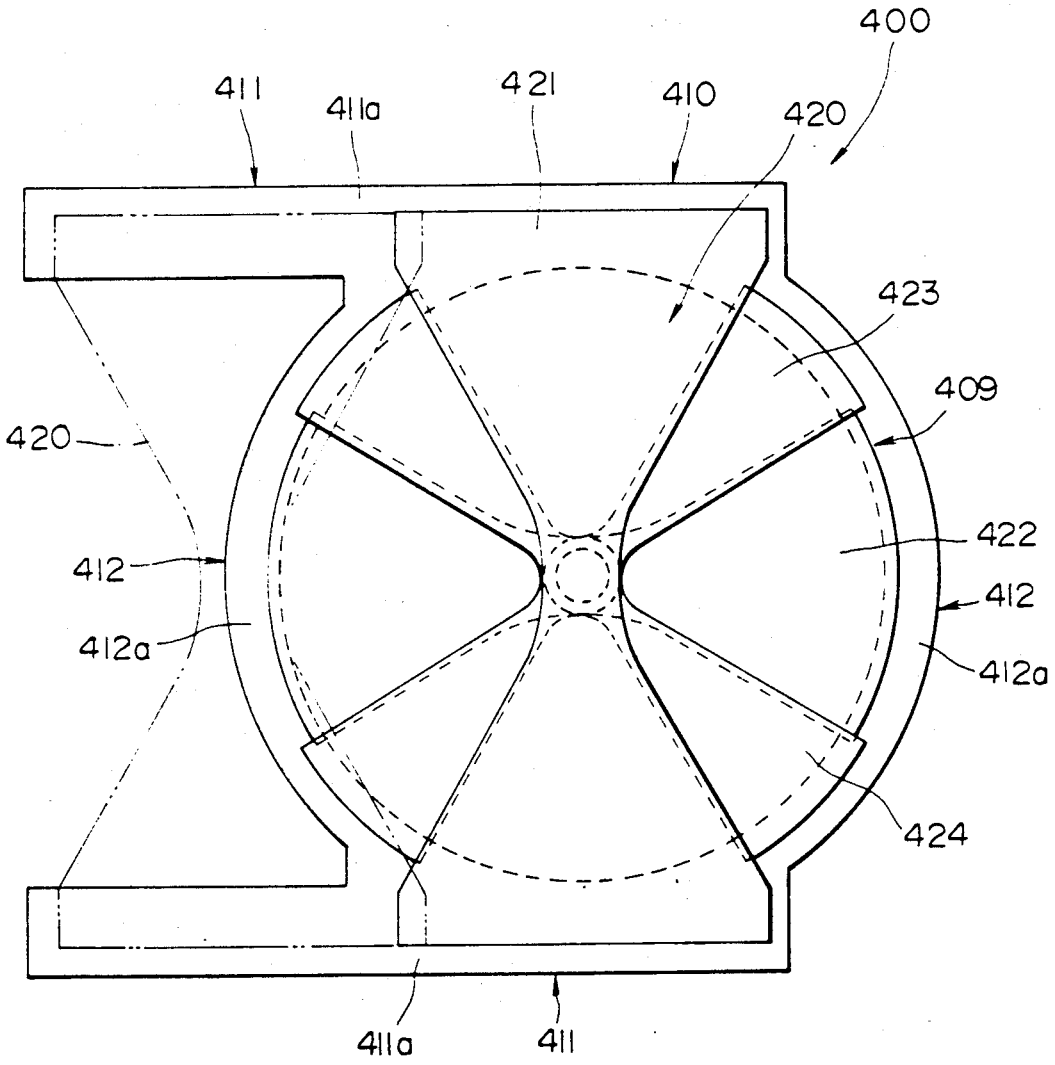
FIG. 15 is a top plan view of an openable roof apparatus according to a fourth embodiment of the invention, showing a movable roof structure moved to a closed position.
Figure 16:
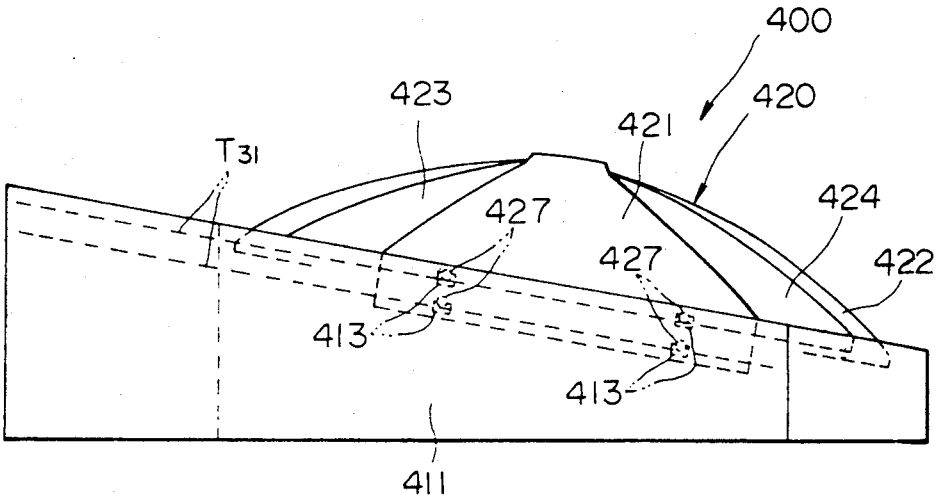
FIG. 16 is a side elevational view of the openable roof apparatus illustrated in FIG. 15.
Figure 17:
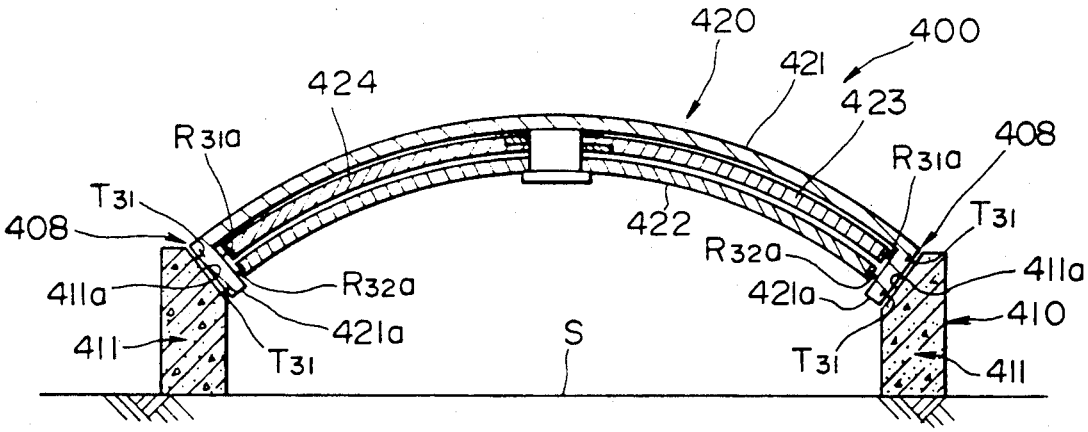
FIG. 17 is a cross-sectional view of the openable roof apparatus illustrated in FIG. 15, showing the movable roof structure moved in an intermediate position.

Referring next to FIGS. 15 through 17, there is shown an openable roof apparatus, generally designated by the reference numeral 400, according to a fourth embodiment of the invention. The openable roof apparatus 400 is applied to a large space S (refer to FIG. 17) such as, for example, a baseball stadium, which is substantially circular in plan, similarly to the first embodiment described previously with reference to FIGS. 1 through 4. The openable roof apparatus comprises a stationary support structure 410 and a movable roof structure 420. The movable roof structure 420 comprises a first movable roof section 421 and a second swing roof section 409. The second swing roof section 409 is composed of a main swing roof unit 422 and a pair of subsidiary roof units 423 and 424, similarly to the second embodiment illustrated in FIGS. 5 through 8.

The stationary roof structure 410 has a pair of parallel support sections 411 and 411 which are arranged respectively on both sides of the space S and which extend in parallel relation to each other. The stationary roof structure 410 further has a pair of arcuate support sections 412 and 412 which are arranged respectively on both sides of the space S and which extend between the pair of parallel support sections 411 and 411 in facing relation to each other.

The pair of parallel support sections 411 and 411 have their respective support surfaces 411*a* and 411*a* which are inclined downwardly toward each other, as will be seen from FIG. 17. The support surfaces 411*a* and 411*a* are inclined with respect to a horizontal plane. On the other hand, as shown in FIG. 15, the arcuate support sections 412 and 412 have their respective support surfaces 412*a* and 412*a* which are inclined toward each other and which are inclined in parallel relation to the support surfaces 411*a* and 411*a* of the respective parallel support sections 411 and 411. Although not shown, three pairs of arcuate rails are provided respectively on the support surfaces 412*a* and 412*a*, similarly to the second embodiment described with reference to FIGS. 5 through 8.

As shown in FIG. 17, a pair of guides 408 and 408 are arranged respectively on the support surfaces 411*a* and 411*a* of the respective support sections 411 and 411 and extend in an inclined manner with respect to the horizontal plane and obliquely to a plane including a central axis of the space S. The first movable roof section 421 and the second swing roof section 409, which are overlapped with each other, are movable along the pair of guides 408 and 408 toward and away from the space S subsequently to be described. The pair of guides 408 and 408 have their respective pairs of straight inclined rails $T_{31}$ and $T_{31}$ which are arranged respectively on the support surfaces 411*a* and 411*a* of the respective parallel support sections 411 and 411. The first movable roof section 421 has its both ends which are mounted respectively on the two pairs of inclined straight rails $T_{31}$ and $T_{31}$ for movement therealong. Each pair of straight rails $T_{31}$ and $T_{31}$ extend obliquely and straight on corresponding ones of the support surfaces 411*a* and 411*a* of the respective parallel support sections 411 and 411. The pair of arcuate support sections 412 and 412 cooperate with each other to define a circle inscribing the pair of parallel support sections 411 and 411.

As illustrated in FIG. 16, two pairs of racks 413 are arranged on each of the pair of parallel support sections 411 and 411 in parallel with the corresponding pair of inclined straight rails $T_{31}$ and $T_{31}$. Two pairs of pinion gears 427 are arranged on each of the both innermost sides of the first movable roof section 421. The pinion gears 427 are in mesh respectively with the racks 413 to prevent slippage of the first movable roof section 421 at start and stop thereof respectively along the pair of inclined straight rails $T_{31}$ and $T_{31}$ on the pair of parallel support sections 411 and 411.

Further, two pairs of arcuate rails (not shown) are mounted respectively on the support surfaces 412*a* and 412*a* of the respective arcuate support sections 412 and 412, similarly to the second embodiment shown in FIGS. 5 through 8.

Similarly to the first embodiment described above with reference to FIGS. 1 through 4, the movable roof structure 420 is movable among a closed position illustrated in FIGS. 15 and 16 where the first movable roof section 421 and the main and subsidiary swing roof sections 422, 423 and 424 of the second swing roof section 409 cooperate with each other to close the space S, and intermediate position illustrated in FIG. 17 where the main and subsidiary swing roof units 422, 423 and 424 are moved angularly about the central axis of the space S and are overlapped with each other and with the first movable roof section 421 to partially open the space S, and an open position where the first movable roof section 421 and the main and subsidiary swing roof units 422, 423 and 424, which are overlapped with each other in the intermediate position, are moved along the pair of guides 408 and 408 away from the space S to open the same.

The second roof section 420 comprises the four movable roof elements each of which has a butterfly configuration in plan centering around a vertical central axis of the space S as shown in FIG. 15, and which has an arch-shaped cross-sectional configuration as shown in FIG. 17. That is, the movable roof structure 420 comprises the first movable roof section 421 and the second swing roof section 409 which is composed of the main swing roof unit 422 and the pair of subsidiary swing roof units 423 and 424. The main swing roof of unit 422 and the pair of subsidiary swing roof units 423 and 424 have their respective both ends which are mounted respectively on the two pairs of arcuate rails for movement therealong. In the intermediate position, the pair of subsidiary swing roof units 423 and 424 are located between the main swing roof unit 422 and the first movable roof section 421 in side-by-side relation to each other, and the main swing roof unit 422 is overlapped with the pair of subsidiary swing roof units 423 and 424 and with the first movable roof section 421 in a laminated manner.

In the closed position, the main swing roof unit 422 has its axis which extends perpendicularly to that of the first movable roof section 421.

As shown in FIG. 17, the first movable roof section 421 has its both ends 421*a* and 421*a* which are bent inwardly in an L-shape along the support surfaces 411*a* and 411*a* with respect to the remaining body of the first movable roof section 421. Each of the L-shaped ends 421*a* and 421*a* of the first movable roof section 421 has a pair of acruate rail sections $R_{31a}$ and $R_{32a}$ for supporting corresponding ones of the both ends of the respective main and subsidiary swing roof units 422, 423 and 424. The arcuate rail sections $R_{31a}$ and $R_{32a}$ are the same in level as the two pairs of arcuate rails on the respective arcuate support sections 412 and 412 so that the main and subsidiary swing roof units 422, 423 and 424 can be moved to and from the arcuate rail sections $R_{31a}$ and $R_{32a}$ and the two pairs of arcuate rails. The L-shaped ends 421*a* and 421*a* of the first movable roof section 421 are bent toward each other, and are located below the remaining body of the first movable roof section 421.

Referring next to FIGS. 18 through 30, there is shown an openable roof apparatus, generally designated by the reference numeral 504, according to a fifth embodiment of the invention. The openable roof apparatus 504 is applied to a large space such as, for example, a baseball stadium 501, similarly to the first embodiment described previously with reference to FIGS. 1 through 4. As shown in FIG. 20, the baseball stadium 501 comprises a ground 502 which is substantially circular in plan, and a plurality of audience seats 503 provided about the ground 502. The openable roof apparatus 504 for the stadium 501 comprises a stationary support structure 507 arranged about the ground 502 and a movable roof structure 551 which is supported by the stationary support structure 507 and which is movable with respect thereto.

The movable roof structure 551 has a first movable roof section 506 and a second swing roof section 505. The second swing roof section 505 is movable angularly about a central axis of the ground 502 with respect to the first movable roof section 506 and is capable of being overlapped therewith.

A guide arrangement 552 is arranged on the stationary support structure 507 and extends perpendicularly to a plane including the central axis of the ground 502. The first movable roof section 506 and the second swing roof section 505, which are overlapped with each other, is movable along the guide arrangement 552 toward and away from the ground 502.

Figure 18:
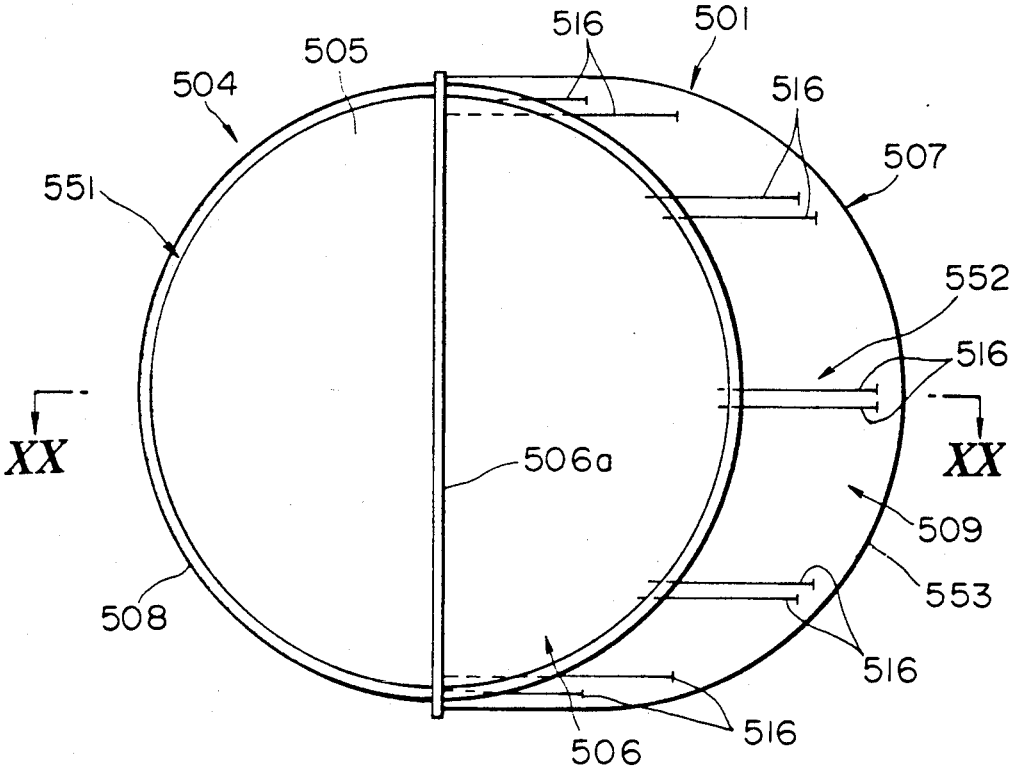
FIG. 18 is a top plan view of an openable roof apparatus in its closed position according to a fifth embodiment of the invention.
Figure 19:
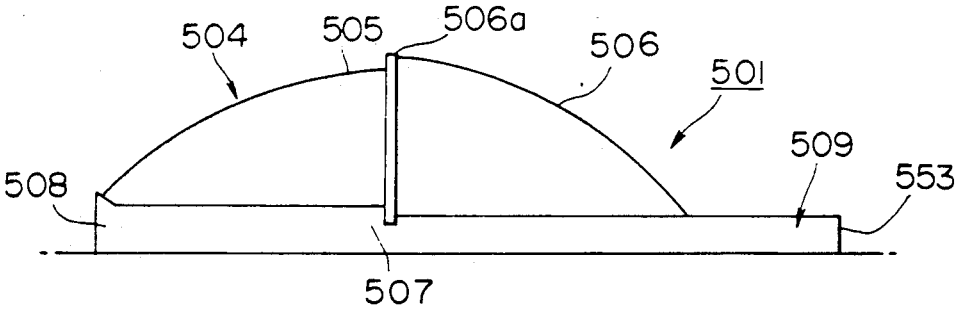
FIG. 19 is a side elevational view of the openable roof apparatus illustrated in FIG. 18.
Figure 20:
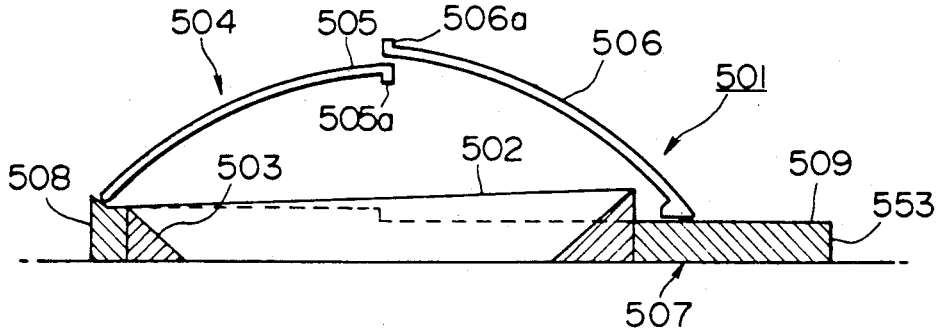
FIG. 20 is a cross-sectional view taken along the line XX—XX in FIG. 18.
Figure 21:
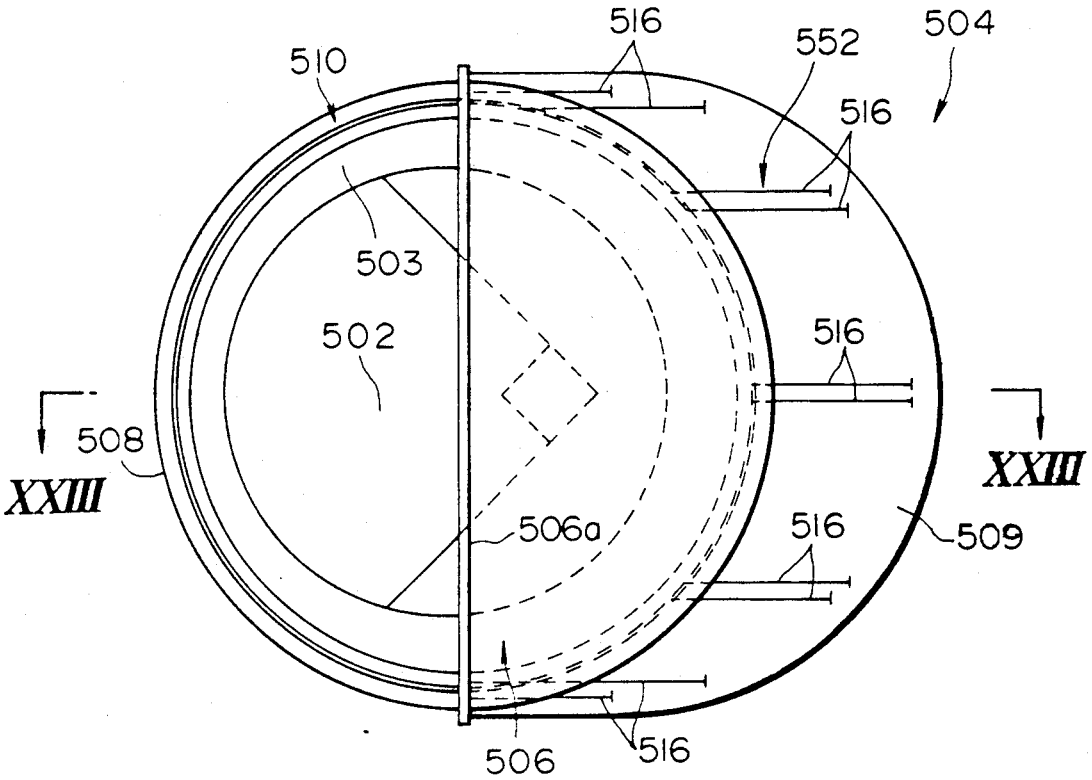
FIG. 21 is a top plan view of a movable roof section of the openable roof apparatus illustrated in FIG. 18, which is overlapped by a stationary roof section.
Figure 22:
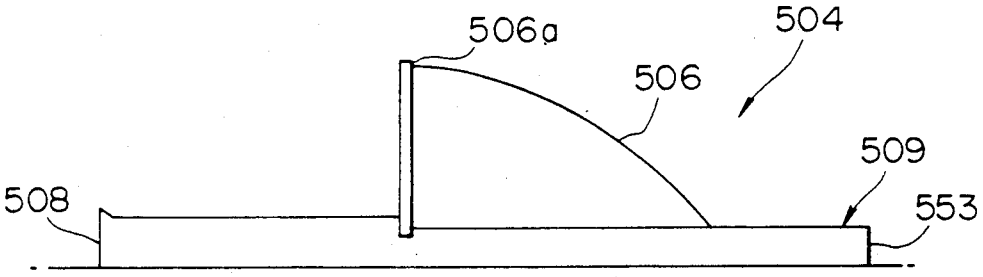
FIG. 22 is a side elevational view of openable roof apparatus illustrated in FIG. 21.
Figure 23:
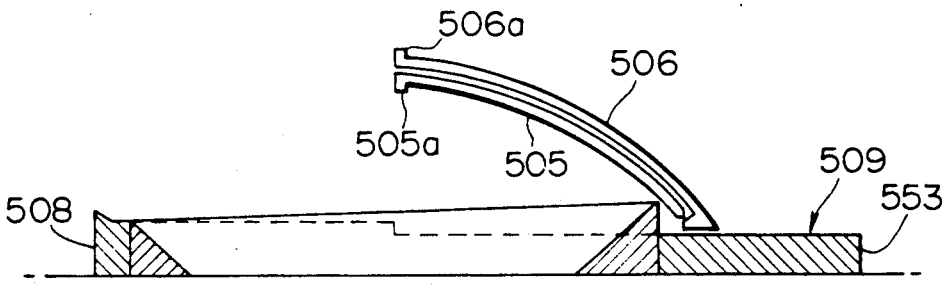
FIG. 23 is a cross-sectional view taken along the line XXIII—XXIII in FIG. 21.
Figure 24:
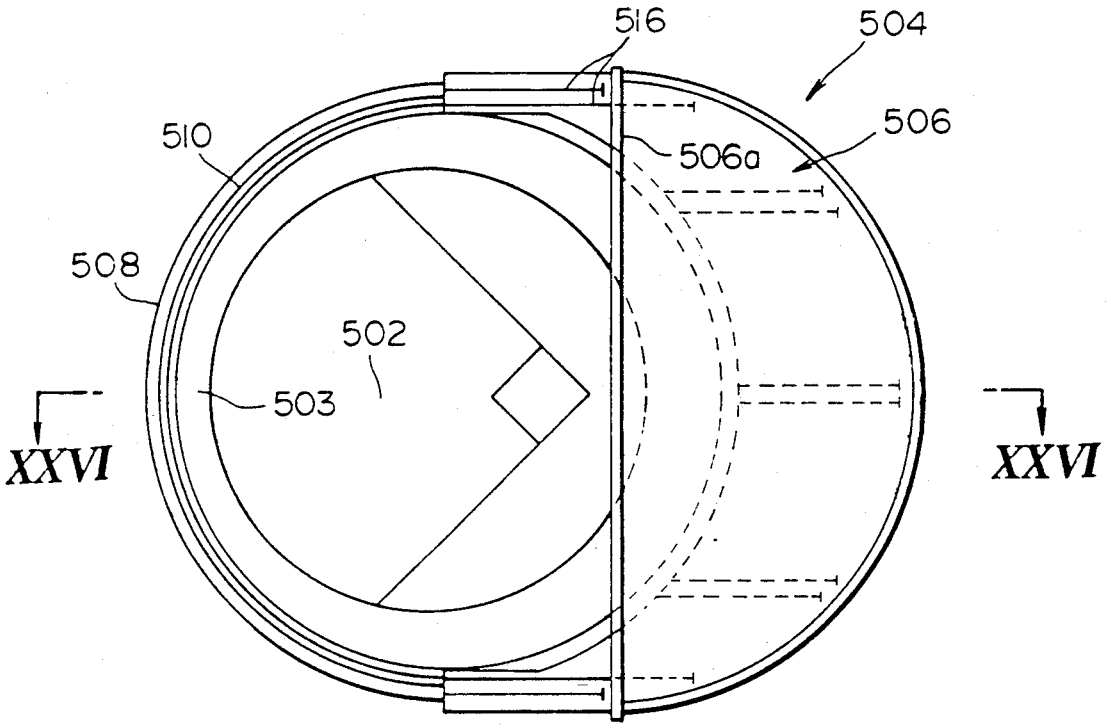
FIG. 24 is a top plan view of the openable roof apparatus illustrated in FIG. 18, in its open position.
Figure 25:
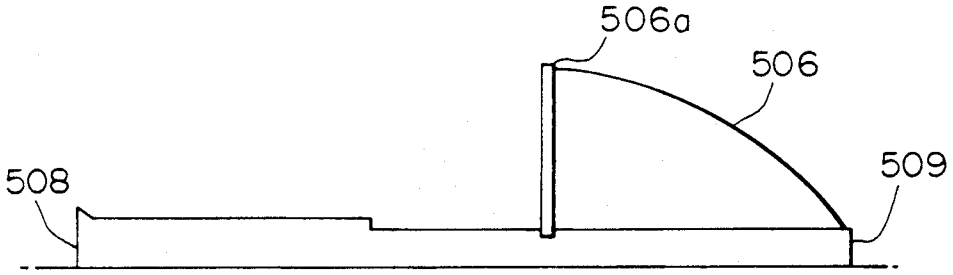
FIG. 25 is a side elevational view of the openable roof apparatus illustrated in FIG. 24.
Figure 26:
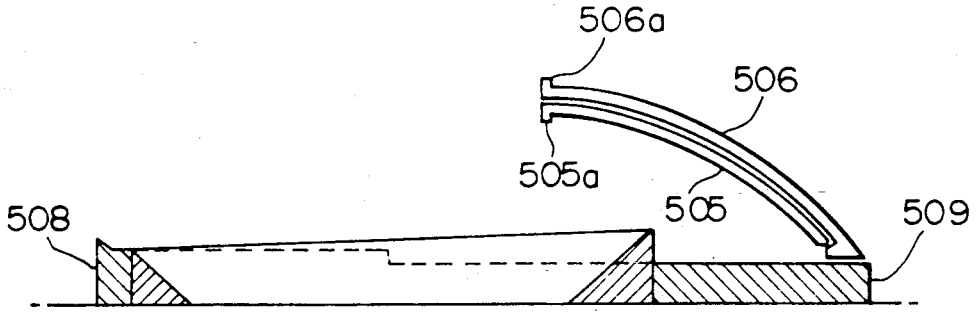
FIG. 26 is a cross-sectional view taken along the line XXVI—XXVI in FIG. 25.

The movable roof structure 551 is movable among a closed position illustrated in FIG. 18 through 20 where the first movable roof section 506 and the second swing roof section 505 cooperate with each other to close the ground 502, an intermediate position illustrated in FIGS. 21 through 23 where the second swing roof section 505 is moved angularly about the central axis of the ground 502 and is overlapped with the first movable roof section 506 to partially open the ground 502, and an open position illustrated in FIGS. 24 through 26 where the first movable roof section 506 and the second swing roof section 505, which are overlapped with each other in the intermediate position, are moved along the guide arrangement 552 away from the ground 502 to open the same.

As clearly shown in FIG. 18, each of the first movable roof section 506 and the second swing roof section 505 is generally semi-circular in plan having a semi-circular bow and a chord connecting both ends of the semi-circular bow to each other, so that the movable roof structure 551 is generally circular in plan in the closed position and has a dome-shaped configuration projecting upwardly like a turned-over partial spherical body.

As shown in FIG. 20, the first movable roof section 506 has its radius of curvature which is larger than that of the second swing roof section 505 substantially by a wall thickness thereof so that, in the intermediate position, the second swing roof section 505 is arranged on the inside of the first movable roof section 506 in a lmainated or superimposed manner at a location below the first movable roof section 506, as illustrated in FIG. 23.

Referring back to FIG. 18, the stationary support structure 507 is provided about the audience seats 503, and is substantially annular in plan. The stationary support structure 507 has a first semi-circular support section 508 on which, in the closed position, the second swing roof section 505 is arranged, and a second support section 509 on which, in the closed position, the first movable roof section 506 is arranged. The second support section 509 has an extension 553 which extends away from the ground 502. The guide arrangement 552 is arranged on the extension 553 of the second support section 509.

Figure 27:
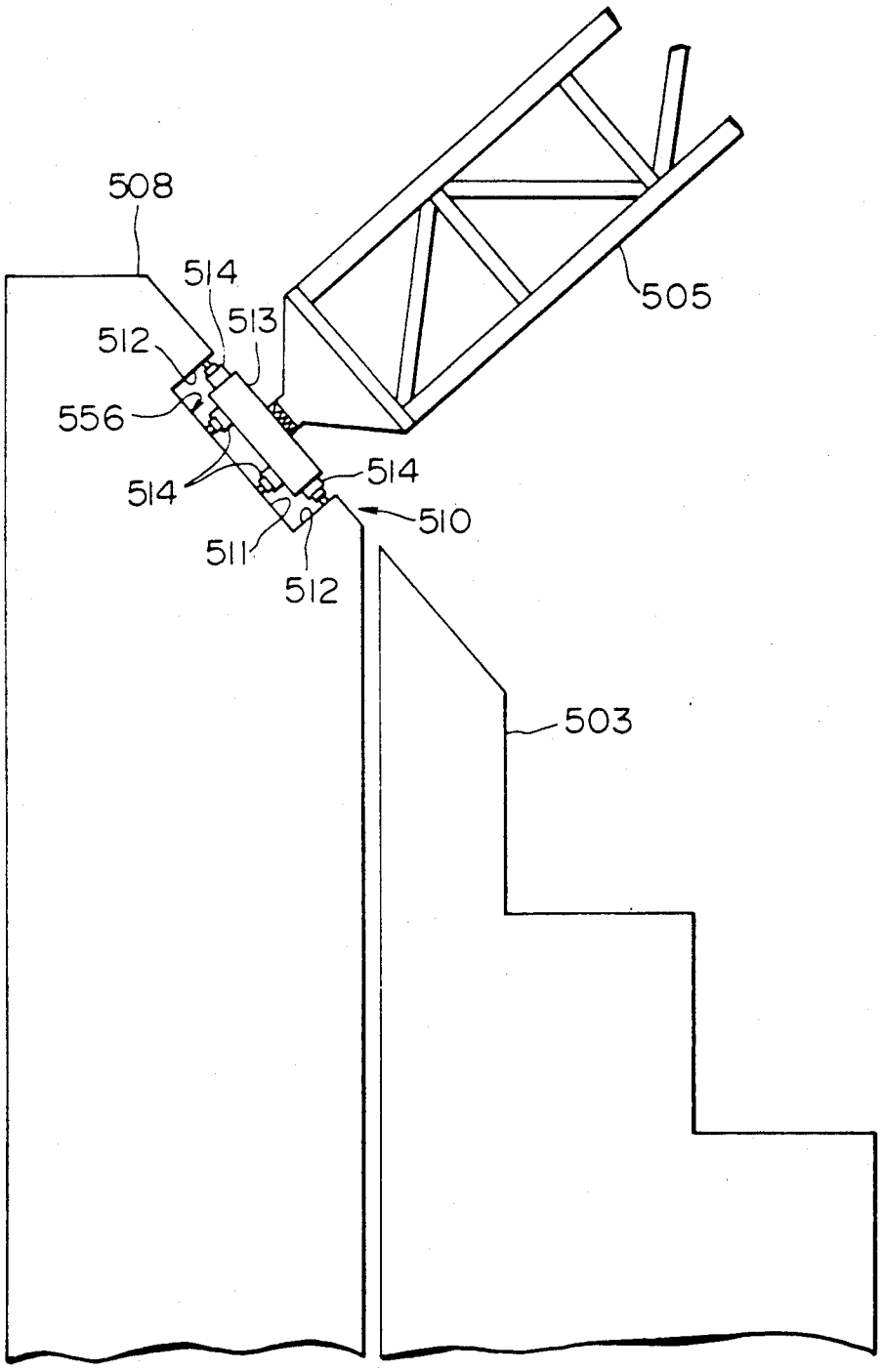
FIG. 27 is a fragmentary enlarged cross-sectional view showing an end of a second swing roof section illustrated in FIG. 18.
Figure 29:
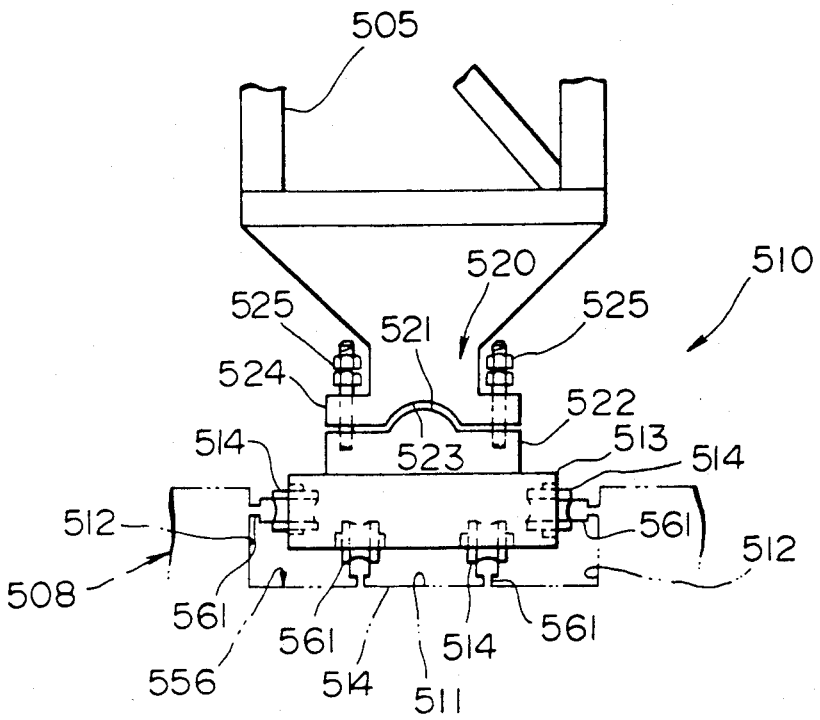
FIG. 29 is a fragmentary front elevational view of a support arrangement for the second swing roof section in the openable roof apparatus illustrated in FIG. 27.

As shown in FIG. 21, and arcuate or semi-circular guide 510 is arranged on the first semi-circular support section 508. The arcuate guide 510 has its radius of curvature in plan which is slightly smaller than that of an outer periphery of the first semi-circular support section 508. The second swing roof section 505 has its peripheral edge which rests on the arcuate guide 510. That is, as shown in FIG. 27, the arcuate guide 510 has an arcuate groove 556 which is formed in the first semi-circular support section 508. The arcuate groove 556 has its bottom surface 511 which extends perpendicularly to an extension of the peripheral edge of the second swing roof section 505. A plurality of trucks 513 each having a drive mechanism is arranged within the annular groove 556. That is, the plurality of trucks 513 are fitted in the arcuate groove 556 for movement therealong. Each of the trucks 513 has a plurality of wheels 514. More specifically, as shown in FIG. 29, the arcuate guide 510 has a pair of rails 561 and 561 which are laid on the bottom surface 511 of the arcuate groove 556. The wheels 514 rest on the rails 561 for movement therealong. The arcuate groove 556 in the semi-circular support section 508 has both side surfaces 512 and 512. Each of the trucks 513 has another pair of wheels 514 which rest respectively on another pair of rails 561 on the side surfaces 512 for receiving a thrust force acting upon the truck 513.

Figure 28:
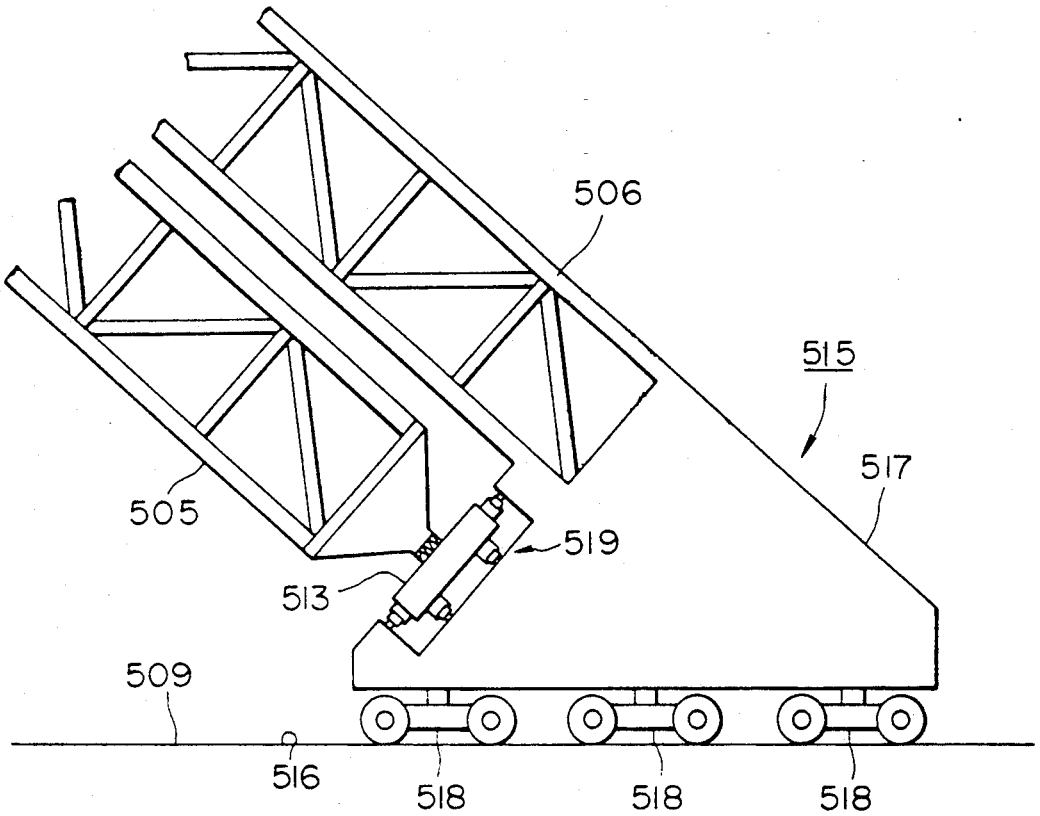
FIG. 28 is a fragmentary enlarged cross-sectional view showing an end of a stationary roof structure illustrated in FIG. 18.

As shown in FIG. 28, an arcuate guide 519 is arranged on an inward peripheral edge of the first movable roof section 506. The arcuate guide 519 cooperates with the aforesaid semi-circular guide 510 to define a circular guide arrangement in the closed position. Thus, the second swing roof section 5052 can be moved angularly about the central axis of the ground 502. The arcuate guide 519 is the same in construction as the semi-circular guide 510.

Figure 30:
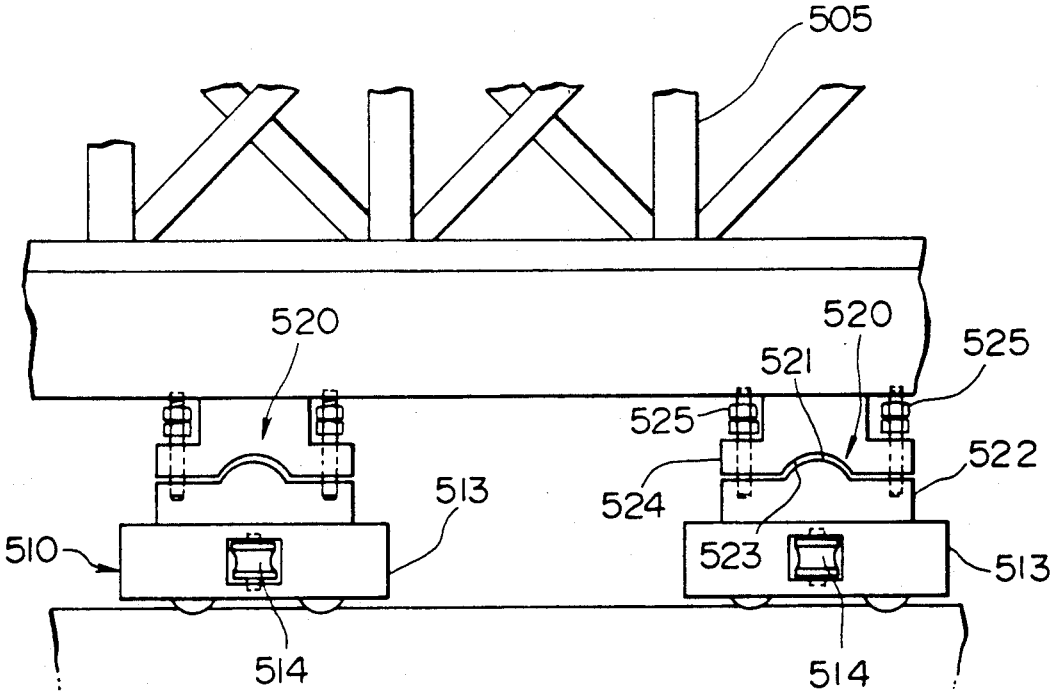
FIG. 30 is a fragmentary side elevational view of the support arrangement illustrated in FIG. 29.

As shown in FIGS. 29 and 30, the plurality of trucks 513 rest on the rails 561 of the semi-circular guide 510, and a plurality of spherical joint arrangements 520 are arranged between the second swing roof section 505 and the trucks 513 resting on the rails 561 of the semi-circular guide 510 on the semi-circular support section 508. Each of the spherical joint arrangements 520 includes a support member 522 which is arranged on the truck 513 and which has a semi-spherical surface 521 projecting upwardly. An attaching member 524 has therein a concave 523 and is mounted on the peripheral edge of the second swing roof section 505. The semi-circular surface 521 of the support member 522 is fitted in the concave 523 in the attaching member 524. That is, the plurality of trucks 513 are arranged on the semi-circular guide 510 in spaced relation to each other, and each of the joint arrangements 520 includes the support member 522 arranged on the truck 513 and the attaching member 524 mounted on the peripheral edge of the second swing roof section 505.

The support member 522 and the attaching member 524 are loosely connected to each other by a plurality of comming-out preventing bolts 525 under such a condition that the support member 522 and the attaching member 524 are spaced a predetermined distance from each other. In this manner, the second swing roof section 505 is supported angularly movably about the semi-spherical surface 521. Thus, even if a force acting upon the second swing roof section 505 and a direction of the force change, the spherical joint arrangement 520 suitably moves angularly. Thus, no unreasonable force acts upon the truck 513 so that the latter can move smoothly. Particularly, in the fifth embodiment, since the thrust receiving wheels 514 are arranged on the both side surfaces of the truck 513 as shown in FIG. 29, the truck 513 does not slip out of the rails 561. Thus, the thrust receiving wheels 514 are preferable very much.

Referring back to FIG. 19, the second support section 509 has its upper surface which is located lower than an upper surface of the first semi-circular support section 508. The upper surface of the second support section 509 is inclined downwardly away from the ground 502. As shown in FIG. 28, a movable truck device 515 having a plurality of drive mechanisms is interposed between the peripheral edge of the first movable roof section 506 and the second support section 509. The movable truck device 515 is laid on a plurality of pairs of rails 516 which are laid on the extension 553 of the second support section 509.

That is the movable truck device 515 comprises substantially a base 517 provided at the lower peripheral edge of the first movable roof section 506 and a plurality of traveling wheels 518 provided at the lower surface of the base 517. The arcuate or semi-circular guide 519 is formed on the base 517 at a location the same in level as the semi-circular guide 510. Accordingly, the swing roof section 505 is movable angularly about the cener of the ground 502 not only along the semi-circular guide 510 of the support section 508, but also along the semi-circular guide 519 of the first movable roof section 506.

In connection with the above, as an operating method of the tracks 513 and the movable truck device 515, an operator should use well-known means such as means for suitably commanding by, for example, remote control.

As shown in FIG. 18, the pairs of rails 516 are arrange on the extension 553 of the second support section 509. The pairs of rails 516 extend in parallel relation to each other along the extending direction of the extension 553 of the second support section 509. Accordingly, the second swing roof section 505 and the movable roof section 506, which are overlapped with each other in the intermediate position, are so arranged as to be moved toward and away from the audience seats 503 or the ground 502 by movement of the truck device 515 along the pairs of rails 516.

In connection with the above, as shown in FIG. 20, the first movable roof section 506 has a rib 506*a* for reinforcing the first movable roof section 506. The second swing roof section 505 has a rib 505*a* for reinforcing the second swing roof section 505. The rib 506*a* of the first movable roof section 506 is provided along the chord of the first movable roof section 506. The rib 505*a* of the second swing roof section 505 is provided along the chord of the first movable roof section 505.

Particularly, in the fifth embodiment, since the arrangement is such that the second swing roof unit 505 is overlapped with the first movable roof section 506 at a location therebelow, the rib 506*a* on the first movable roof section 506 extends upwardly therefrom, while the rib 505*a* on the second swing roof section 505 extends downwardly therefrom, in order that the ribs 505*a* and 506*a* are not a hindrance to the angular movement of the second swing roof section 505.

The operation of the openable roof apparatus according to the fifth embodiment, which is constructed as above, will be described below.

As shown in FIGS. 18 through 20, in case where the swing roof section 505 is located on the left-hand side of the ground 502, while the movable roof section 506 is located on the right-hand side of the ground 502, the swing roof section 505 and the movable roof section 506 cooperate with each other to cover the upper portions of the respective ground 502 and audience seats 503, to form the single large movable roof structure 551 on the ground 502 and the audience seats 503. By doing so, the ground 502 and the audience seats 503 can take shelter from the rain and wind. Thus, even if it is bad in weather, people can sufficiently enjoy a match or contest and a watch.

On the other hand, in order to move the movable roof structure 551 from its closed position to the open position, an operator commands, by remote control, beginning to start movement of the tracks 513 located at the peripheral edge of the swing roof section 505. By doing so, the trucks 513 move on the rails 561 toward the movable roof section 506, and the swing roof section 505 also moves with the movement of the trucks 513. As a result, the swing roof section 505 is moved to the intermediate position where the swing roof section 505 is overlapped with the movable roof section 505 at the location therebelow. Thus, a position, where the swing roof unit 505 has been located, is open largely as shown in FIGS. 21 through 23.

Subsequently, in the intermediate position where the swing roof section 505 is overlapped with the movable roof section 506 at the location therebelow, the operator commands, by remote control, beginning to start movement of the movable truck device 515 which is located at the peripheral edge of the movable roof section 506. Thus, the movable truck device 515 moves on the pairs of rails 516 away from the audience seats 503, and the swing roof section 505 and the movable roof section 506 also move with the movement of the movable truck device 515. By doing so, as shown in FIGS. 24 through 27, the greater part or great majority of the upper portion of the ground 502 is open so that the movable roof structure 551 is removed from the ground 502. Accordingly, people on the audience seats 503 can enjoy sunshine, a gentle breeze and so on from the open area.

Further, in order to move the movable roof structure 551 from the open position to the closed position, the trucks 513 and the movable truck device 515 are moved in a direction which is opposite or reverse to that described above.

In this manner, according to the openable roof apparatus 500 according to the fifth embodiment, constructed as described above, the swing roof section 505 is moved angularly about the central axis of the ground 502 to a location below the movable roof section 506, and the swing roof section 505 and the movable roof section 506 are moved away from the audience seats 503 along the pairs of rails 516, whereby the upper portion of the ground 502 can be opened and closed. Thus, release or liberation and closure of the upper portion of the respective ground 502 and audience seats 503 are conducted entirely freely and simply, so that it is possible to cope with weather at person's beck and call.

Furthermore, in this fifth embodiment, the dome-shaped movable roof structure 551, which is partially spherical in shape, is divided into two elements, and one of the two elements is formed by the swing roof section 505. Thus, the stability of the movable roof structure 551 is high. Further, since the driving locations are low in number, their drive mechanisms are simple in structure or construction. Particularly, the ribs 505*a* and 506*a* are provided respectively along the chords of the respective roof sections 505 and 506 so that the chords are reinforced. Thus, it is possible to improve the stability of the movable roof structure 551.

Moreover, the swing roof section 505 is moved angularly about the central axis of the ground 502 so that the swing roof section 505 is overlapped with the movable roof section 506 at the location therebelow, and the swing roof section 505 and the movable roof section 506 are moved in unison horizontally, whereby the movable roof structure 551 is open, that is, is moved between the open and closed positions. Thus, the leaving space for the movable roof structure 551 can be reduced, and the openable roof apparatus 500 is rational very much.

In connection with the above, in the fifth embodiment illustrated in FIGS. 18 through 30, the dome-shaped movable roof structure 551 in the form of a partial sphere is divided into two elements which are constituted respectively by the swing roof section 505 and the movable roof section 506. Accordingly, a slight gap or clearance is required between the swing roof section 505 and the movable roof section 506 at their respective chords, because the swing roof section 505 and the movable roof section 506 are deformed into their shapes different from each other vertically by a change of temperature and the like. Thus, there is the case where means is required for preventing rain from entering the ground 502 through the chords of the respective swing and movable roof sections 505 and 506.

Figure 31:
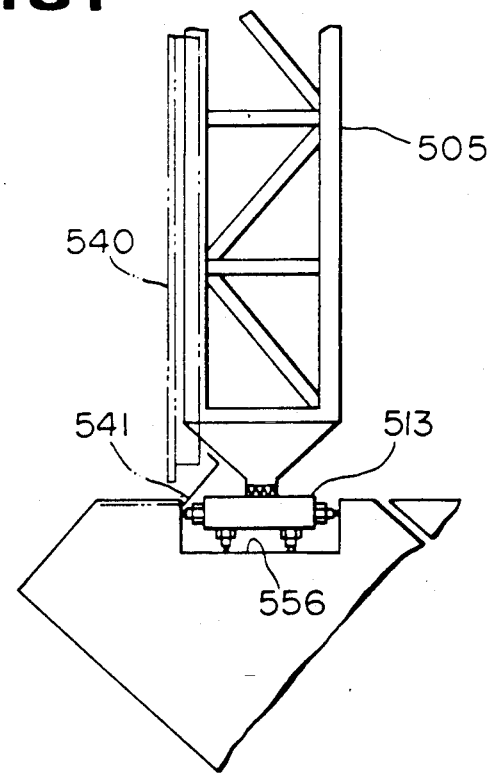
FIG. 31 is a fragmentary side elevational view showing an example of a preventing structure for rain in the second swing roof section illustrated in FIGS. 29 and 30.
Figure 35:
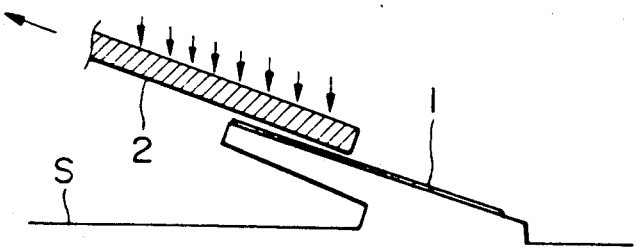
FIG. 35 (PRIOR ART)
FIG. 35 is a fragmentary cross-sectional view of the conventional openable roof apparatus.
Figure 36:
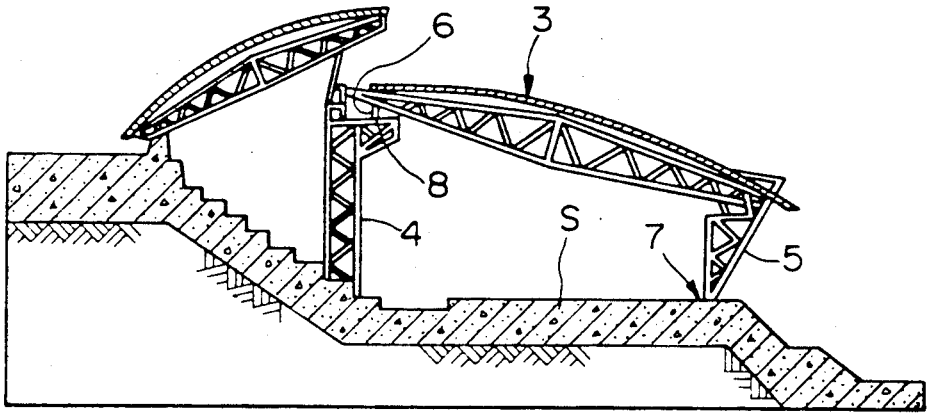
FIG. 36 (PRIOR ART)
FIG. 36 is a cross-sectional side elevational view showing another conventional openable roof apparatus.
Figure 37:
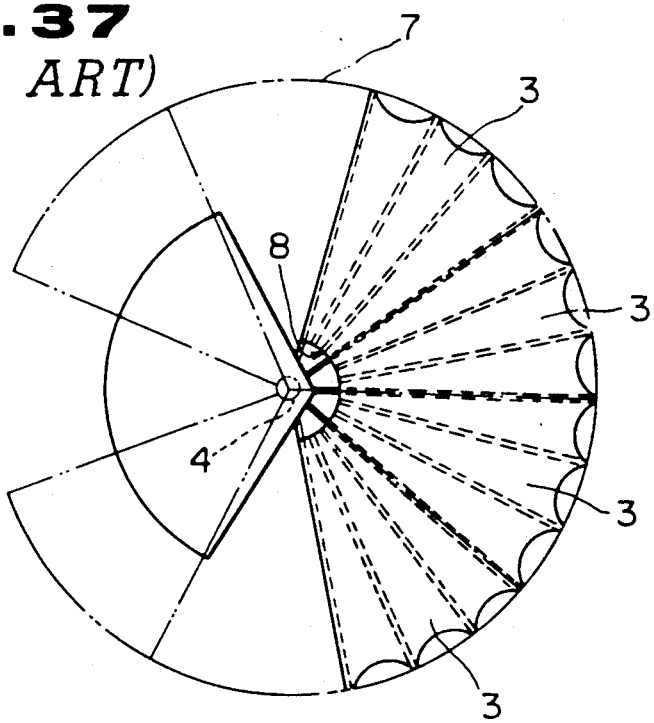
FIG. 37 (PRIOR ART)
FIG. 37 is a schematic top plan view of the openable roof apparatus illustrated in FIG. 36.

As an example of such rain preventing means, as shown in FIG. 31, a first eaves trough 540 is provided along the chord of the second swing roof section 505, and a second eaves trough 541 is arranged on the first semi-circular support section 508 at a location above the arcuate groove 556. Further, the following means is also preferable. That is, a seal element such a rubber sheet or the like is arranged along the chord of the swing roof unit 505. The seal element projects upwardly along the chord of the swing roof unit 505. In this manner, the gap or clearance is sealed between the chords of the respective swing and movable roof sections 505 and 506. Moreover, the following means is also preferable. That is, in place of the seal element, a rubber tube is arranged along the chord of the swing roof section 505, and is inflated in the closed position of the movable roof structure 551.

Figure 32:
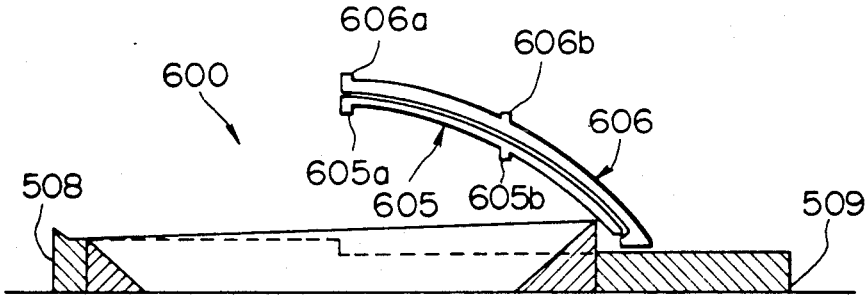
FIG. 32 is similar to FIG. 23, but showing an openable roof apparatus according to a sixth embodiment of the invention.

Referring next to FIG. 32, there is shown an openable roof apparatus 600 according to a sixth embodiment of the invention. The openable roof apparatus 600 is similar in structure or construction to the fifth embodiment illustrated in FIGS. 18 through 30. Accordingly, the same or like reference numerals are used to designate components like or similar to those illustrated in FIGS. 18 through 30, and the description of such like or similar components will be omitted to avoid repetition.

In the sixth embodiment, the rib arrangement of the first movable roof section 606 has a first rib 606*a* provided along the chord of the first movable roof section 606 and a second rib 606*b* provided on the first movable roof section 606 in parallel relation to the first rib 606*a* at a location between the chord of the first movable roof section 606 and an end thereof remotest from the chord of the first movable roof section 606. The rib arrangement of the second swing roof section 605 has a first rib 605*a* provided along the chord of the first movable roof section 605 and a second rib 605*b* provided on the first movable roof section 605 in parallel relation to the first rib 605*a* at a location between the chord of the first movable roof section 605 and an end thereof remotest from the chord of the first movable roof section 605.

It is needless to say that, in the fifth and sixth embodiments, if reinforcing is unnecessary in the viewpoint of construction, such ribs are dispensed with.

Figure 33:
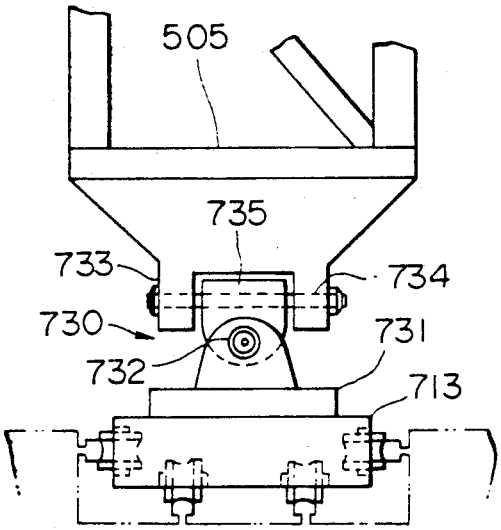
FIG. 33 is similar to FIG. 29, but showing an openable roof apparatus according to a seventh embodiment of the invention.
Figure 34:
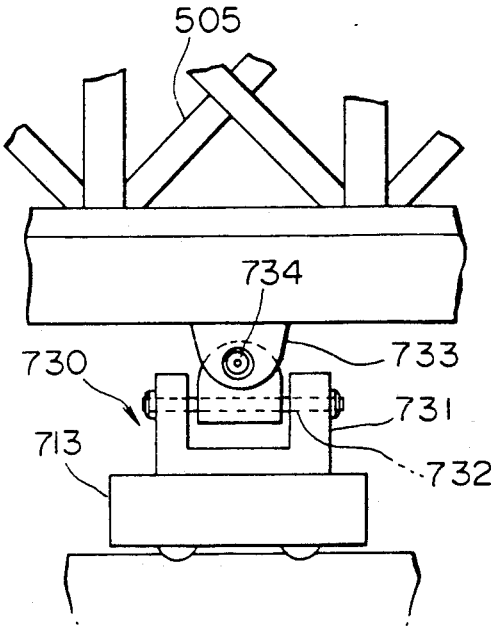
FIG. 34 is a fragmentary side elevational view of the openable roof apparatus illustrated in FIG. 33.

Referring next to FIGS. 33 and 34, there is shown an openable roof apparatus according to a seventh embodiment of the invention. The openable roof apparatus is similar in structure or construction to the fifth embodiment illustrated in FIGS. 18 through 30. Accordingly, the same or like reference numerals are used to designate components like or similar to those illustrated in FIGS. 18 through 30, and the description of such like or similar components will be omitted to avoid repetition.

A flexible joint 730 uses a pair of pins having their respective pivotal axes which extend perpendicularly to each other. That is, a support member 731 having a generally U-shaped configuration in side view is provided on an upper surface of a movable truck 713. A pin 732 is supported by the support member 731 in an angularly movable fashion. On the other hand, a support member 733 and a pin 734, which are similar to those of the truck 713, are provided on an end of the swing roof section 505. The pins 732 and 734 have their respective pivotal axes which extend perpendicularly to each other. The pins 732 and 734 are loosely fitted in a common connecting member 735. By doing so, the swing roof section 505 is connected to the movable truck 713 through the pins 732 and 734 and the connecting member 735. The connecting member 735 is moved angularly about the pins 732 and 734. Thus, the swing roof section 505 is pivotally supported by the truck 713. Accordingly, the seventh embodiment can obtain functional advantages similar to those of the fifth embodiment described with reference to FIGS. 18 through 30.

In the fifth through seventh embodiments illustrated respectively in FIGS. 18 through 31, in FIG. 32 and in FIGS. 33 and 34, the configuration of each of the swing roof section 505 or 605 and the movable roof section 506 or 606 is optional. In the fifth through seventh embodiments, the movable roof structure 551 has its construction in which the movable roof structure 551 is divided into two elements straight through the central axis of the ground 502. It is of course, however, that, for example, each of the swing roof section 505 or 605 and the movable roof section 506 or 606 may have its chord which is arcuate in plan. Further, of the stationary support structure 507, the support section 509 supporting the movable roof section 506 may not be a body construction, but may merely be a frame which supports the rails. Moreover, it is needless to say that, not only the movable roof section 506 or 606 is movable by the trucks device 515, but also the movable roof section 506 or 606 may be movable by an air-levitation mechanism, a crawler drive mechanism or the like.

What is claimed is:

1. An openable roof apparatus for a space having its central axis, comprising:

a stationary support structure arranged about said space;

a movable roof structure supported by said stationary support structure and movable with respect thereto, said movable roof structure consisting of only two movable roof sections, each of said two roof sections projecting substantially completely over a full semi-circle, said two roof sections including a first movable roof section and a second swing roof section each of which is generally semi-circular in plane and each having a respective load distributed over a generally semi-circular area so as to improve the stability of said movable roof structure, wherein said second swing roof section is movable angularly about the central axis of said space with respect to said first movable roof section and is capable of being overlapped therewith; and guide means arranged on said stationary support structure and extending perpendicularly to a plane including the central axis of said space, said first movable roof section and said second swing roof section, which are overlapped with each other, being movable along said guide means toward and away from said space, wherein said movable roof structure is movable among a closed position where said first movable roof section and said second swing roof section cooperate with each other to close said space, an intermediate position where said second swing roof section is moved angularly about the central axis of said space and is overlapped with said first movable roof section to partially open said space, and an open position wherein said first movable roof section and said second swing roof section, which are overlapped with each other in said intermediate position are moved along said guide means away from said space to open the same.

2. The openable roof apparatus according to claim 1, wherein said movable roof structure is movable horizontally with respect to said stationary support structure.

3. The openable roof apparatus according to claim 1, wherein each of said first movable roof section and said second swing roof section is in the form of an arch in cross-section so that, in said closed position, said movable roof structure is in the form of a dome in plan which is convex upwardly.

4. The openable roof apparatus according to claim 1 wherein each of said first movable roof section and said second swing roof section includes:

a shell portion having an edge extending along a vertical plane, and a semi-circular bow extending along a generally horizontal plane and having first and second opposite ends; and a reinforcing chord having a semi-circular shape, extending along said edge and connecting together said opposite ends of the bow of the roof section, so that said movable roof structure is generally circular in plan in said closed position.

5. The openable roof apparatus according to claim 4, wherein said first movable roof section has its radius of curvature which is larger than that of said second swing roof section by a wall thickness thereof so that, in said intermediate position, said second swing roof section is arranged on the inside of said first movable roof section.

6. The openable roof apparatus according to claim 4, wherein said stationary support structure has a first semi-circular support section on which, in said closed position, said second swing roof section is arranged, and a second support section on which, in said closed position, said first movable roof section is arranged, and wherein said second support section has an extension which extends away from said space, said guide means being arranged on said extension.

7. The openable roof apparatus according to claim 6, wherein said second support section has its upper surface which is located lower than an upper surface of said first semi-circular support section, the upper surface of said second support section being inclined downwardly away from said space.

8. The openable roof apparatus according to claim 4, wherein said guide means includes a plurality of rail means.

9. The openable roof apparatus according to claim 4, further includes a plurality of trucks arranged between said guide means and a peripheral edge of said first movable roof section.

10. The openable roof apparatus according to claim 6, further includes arcuate guide means arranged on said first semi-circular support section, said second swing roof section having its peripheral edge which rests on said arcuate guide means.

11. The openable roof apparatus according to claim 10, wherein said guide means and said arcuate guide means are composed of a plurality of truck means.

12. The openable roof apparatus according to claim 4, wherein said first movable roof section has rib means for reinforcing said first movable roof section, and said second swing roof section has rib means for reinforcing said second swing roof section.

13. The openable roof apparatus according to claim 12, wherein said rib means of said first movable roof section is provided along the chord of said first movable roof section, and said rib means of said second swing roof section is provided along the chord of said first movable roof section.

14. The openable roof apparatus according to claim 13, wherein said rib means of said first movable roof section has a first rib provided along the chord of said first movable roof section and a second rib provided on said first movable roof section in parallel relation to said first rib at a location between said chord of said first movable roof section and an end thereof remotest from said chord of said first movable roof section, and wherein said rib means of said first movable roof section has a first rib provided along the chord of said first movable roof section and a second rib provided on said first movable roof section in parallel relation to said first rib at a location between said chord of said first movable roof section and an end thereof remotest from said chord of said first movable roof section.

15. The openable roof apparatus according to claim 10, wherein said arcuate guide means has an arcuate groove formed in said first semi-circular support section, said arcuate groove having its bottom surface which extends perpendicularly to an extension of the peripheral edge of said second swing roof section, and wherein said openable roof apparatus further includes a plurality of truck means arranged on the peripheral edge of said second swing roof section, said plurality of truck means being fitted in said arcuate groove for movement therealong.

16. The openable roof apparatus according to claim 15, wherein each of said truck means has wheel means, and said arcuate guide means has rail means laid on said bottom surface of said arcuate groove, said wheel means resting on said rail means for movement therealong.

17. The openable roof apparatus according to claim 15, wherein said arcuate groove in said first semi-circular support section has both side surfaces, and each of said truck means has a pair of second wheel means resting respectively on said side surfaces for receiving a thrust force acting upon said truck means.

18. The openable roof apparatus according to claim 10, further includes second arcuate guide means arranged on an inward peripheral edge of said first movable roof section, said second arcuate guide means cooperating with the first-mentioned guide means to define circular guide means in said closed position.

19. The openable roof apparatus according to claim 12, wherein said rib means on said first movable roof section extends upwardly therefrom, while said rib means on said second swing roof section extends downwardly therefrom.

20. The openable roof apparatus according to claim 6, further includes truck means resting on said first semi-circular support section, and joint means arranged between said second swing roof section and said truck means resting on said first semi-circular support section of said stationary support structure.

21. The openable roof apparatus according to claim 4, wherein said truck means includes a plurality of trucks arranged on said first semi-circular support section in spaced relation to each other, and said joint means includes a plurality of support units arranged respectively on said trucks and a plurality of attaching members mounted on the peripheral edge of said second swing roof section, said attaching members having therein their respective concaves, said support units being fitted respectively in said concaves.

22. The openable roof apparatus according to claim 20, wherein said joint means includes support means arranged on said truck means and having a semi-spherical surface projecting upwardly, and attaching means having therein concave means and mounted on a peripheral edge of said second swing roof section, said semi-spherical surface of said support means being fitted in said concave means in said attaching means.

23. The openable roof apparatus according to claim 1 wherein each of said first and second roof sections has a fixed semi-circular shape in plan.

24. The openable roof apparatus according to claim 4, wherein each of said first and second roof sections comprises a shell portion having a generally semi-circular peripheral lower edge portion and a peripheral upper edge portion, wherein the bow of each roof section is connected to and extends along the lower edge portion thereof, and the chord of each roof section is connected to and extends along the upper edge portion thereof.

25. The openable roof apparatus according to claim 1 wherein in said intermediate position, said second roof section is substantially completely overlapped by and is nested within said first roof section.

26. An openable roof apparatus according to claim 4, wherein the reinforcing chord of the first movable roof section extends radially outward from the shell portion of said first roof section, and the reinforcing chord of the second roof section extends radially inward from the shell portion of said second roof section, to facilitate swinging the second roof section inside the first roof section.

* * * * *

UNITED STATES PATENT AND TRADEMARK OFFICE

CERTIFICATE OF CORRECTION

PATENT NO. : 5,117,594

DATED : June 2, 1992

INVENTOR(S) : Hiroki Muramoto, et al.

It is certified that error appears in the above-identified patent and that said Letters Patent is hereby corrected as shown below:

Column 1, line 23: "object" should read as --open--

Column 2, line 24: "centrl" should read as --central--

Column 23, line 54: "5052" should read as --505--

Column 24, line 56: "arrange" should read as --arranged--

Column 31, line 1, Claim 24: "thereof." should read as --thereof,--

Column 32, lines 2 & 4, Claim 26: "section." should read as --section,--

Signed and Sealed this

Twenty-third Day of November, 1993

*Attest:*

*Attesting Officer*

Bruce Lehman

BRUCE LEHMAN

*Commissioner of Patents and Trademarks*